US010147591B2

(12) United States Patent
Derrick et al.

(10) Patent No.: US 10,147,591 B2
(45) Date of Patent: Dec. 4, 2018

(54) ION MIRROR, AN ION MIRROR ASSEMBLY AND AN ION TRAP

(71) Applicant: Aukland UniServices Ltd., Auckland (NZ)

(72) Inventors: Peter Derrick; Igor Filippov, Auckland (NZ)

(73) Assignee: Auckland UniServices Limited, Auckland (NZ)

( * ) Notice: Subject to any disclaimer, the term of this patent is extended or adjusted under 35 U.S.C. 154(b) by 31 days.

(21) Appl. No.: 15/547,408

(22) PCT Filed: Jan. 29, 2016

(86) PCT No.: PCT/GB2016/050203

§ 371 (c)(1),
(2) Date: Jul. 28, 2017

(87) PCT Pub. No.: WO2016/124893

PCT Pub. Date: Aug. 11, 2016

(65) Prior Publication Data

US 2018/0040465 A1 Feb. 8, 2018

(30) Foreign Application Priority Data

Feb. 3, 2015 (GB) ..... 1501806.2

(51) Int. Cl.
*H01J 49/06* (2006.01)
*H01J 49/40* (2006.01)

(52) U.S. Cl.
CPC ..... *H01J 49/061* (2013.01); *H01J 49/405* (2013.01); *H01J 49/406* (2013.01); *H01J 49/408* (2013.01)

(58) Field of Classification Search
USPC ..... 250/287, 292, 396 R
See application file for complete search history.

(56) References Cited

U.S. PATENT DOCUMENTS

| | | | | |
|---|---|---|---|---|
| 3,501,630 | A | 3/1970 | Brubaker | |
| 3,767,914 | A | 10/1973 | Mueller et al. | |
| 3,925,662 | A | 12/1975 | Dawson | |
| 6,384,410 | B1 * | 5/2002 | Kawato | H01J 49/405 250/281 |
| 2007/0284524 | A1 | 12/2007 | Franzen | |
| 2013/0161508 | A1 * | 6/2013 | Sapargaliyev | H01J 49/406 250/282 |

FOREIGN PATENT DOCUMENTS

| | | |
|---|---|---|
| EP | 0 408 288 A1 | 1/1991 |
| EP | 2506288 A1 | 10/2012 |

(Continued)

OTHER PUBLICATIONS

Jun. 30, 2016 International Search Report for PCT/GB2016/050203.

(Continued)

*Primary Examiner* — Kiet T Nguyen
(74) *Attorney, Agent, or Firm* — Hahn Loeser & Parks, LLP

(57) ABSTRACT

An ion mirror (10) for use in a time of flight mass spectrometer (100) comprises a first conductor (20) for producing a quadratic field along a first axis (80), and a second conductor (30) for producing a quadratic field along a second axis (90), the axes (80, 90) being orthogonal.

34 Claims, 20 Drawing Sheets

(56) References Cited

FOREIGN PATENT DOCUMENTS

| | | | |
|---|---|---|---|
| GB | 773689 | | 5/1957 |
| GB | 2 423 864 | A | 9/2006 |
| RU | 2327245 | C2 | 11/2007 |
| RU | 2367053 | C1 | 9/2009 |
| RU | 2387043 | C2 | 10/2009 |
| RU | 2398308 | C1 | 8/2010 |
| RU | 2422939 | C1 | 6/2011 |
| RU | 2444083 | C2 | 11/2011 |
| RU | 2496178 | C2 | 3/2013 |
| RU | 2497226 | C1 | 10/2013 |
| WO | WO 95/33279 | | 12/1995 |

OTHER PUBLICATIONS

Jun. 30, 2016 Written Opinion of International Searching Authority for PCT/GB2016/050203.
Jul. 27, 2015 Office Communication and Search Report in connection with GB 1 501 806.2.

* cited by examiner

ION MIRROR, AN ION MIRROR ASSEMBLY AND AN ION TRAP

The present application is a 35 U.S.C. § 371(c) submission international application no. PCT/GB2016/050203, filed on 29 Jan. 2016 and published in the English language on 11 Aug. 2016 with publication no. WO 2016/124893 A1, which claims priority to GB 1501 806.2 filed in the on 3 Feb. 2015, the disclosure of which is incorporated herein by reference.

The invention relates to an ion mirror, an ion mirror assembly and an ion trap.

Ions are charged particles and are affected by the presence of electric and magnetic fields. Such fields can be used to manipulate the transit of ions, thereby allowing for the analysis of the ions under controlled conditions. For example, ions can be manipulated using known apparatus, such as ion mirrors and ion traps.

Ion mirrors are used in time of flight mass spectrometers. A known ion mirror is a quadratic mirror, which produces a static parabolic electric field. The source of the field is an elongate conductor. The elongate conductor is arranged so that the optical axis of the spectrometer intersects the axis of the elongate conductor and the axis of the elongate conductor is perpendicular to the axis of the spectrometer. In practice, an ion entering a quadratic mirror is subject to the static electric field which causes it to lose kinetic energy until it has stopped. The ion is then repelled by the retarding force, such that it is reflected by the ion mirror. Ions must enter the mirror centrally and therefore the apparatus is restrictive with respect to its alignment.

Further, the use of known ion mirrors with such alignment can only increase the path length of accelerated ions in time of flight mass spectrometers by a limited distance (effectively into and back out of the ion mirror along the same axis). Increasing the ion path length makes improved resolution possible, however, due to the limitations of the known ion mirrors described above, to obtain significant increases in the resolution of time of flight mass spectrometers very large arrangements of apparatus are required, which may be cumbersome and inconvenient. Furthermore, improving the resolution of time of flight mass spectrometers in this way typically results in decreased sensitivity.

Ion traps are used in the form of quadrupole ion traps, Orbitraps and ion cyclotron resonance mass spectrometers. Ion traps typically use electric or magnetic fields, established in a vacuum system, to confine the movement of ions. Ions trapped in ion traps can be analysed by detecting image currents and the resolution improved by increasing the time period for which measurements are made, or by increasing the strength of the applied field. However, similarly to ion mirrors, whilst improved resolution of detection is possible by increasing the path length of trapped ions, the ability to increase path length is limited by the physical size of the apparatus and significant increases in the size of apparatus are required in order to provide significantly improved resolution.

According to a first aspect of the invention there is provided an ion mirror comprising:

- a first means for producing a quadratic field along a first axis;
- a second means for producing a quadratic field along a second axis, the axes being orthogonal; and
- a front plate defining an entry aperture for admission of ions, wherein the first means and the second means are arranged to generate a quadratic field along a first axis and a quadratic field along a second axis by the application of a first potential at the first means and a second potential at the second means, wherein the first potential and the second potential are concurrently alternately and oppositely biased, thereby to define a plane of zero field in between the first means and the second means, the entry aperture lying in the plane of zero field.

In this way, the ion mirror of the invention provides focussing in two directions, which improves sensitivity of measurement when used in a mass spectrometer. It would be expected that entry in the plane of zero field would mean that the ions would not be deflected. The inventors have discovered however that the use of alternately and oppositely biased potentials creates a path of travel which alternates from side to side leading to the ions experiencing a reflecting force, contrary to expectation. This alternating direction of the path also significantly increases the path length thereby improving resolution.

The first means may comprise a first elongate conductor, and the second means may comprise a second elongate conductor, the first elongate conductor conveniently being parallel to the second elongate conductor and spaced therefrom.

Preferably, at least one of the first and second means is arranged to produce a hyberbolic electric field, and preferably both first and second means are arranged to produce a hyberbolic electric field.

According to another aspect of the invention, there is provided an ion mirror assembly comprising:

- an ion mirror comprising:
  - a first means for producing a quadratic field along a first axis;
  - a second means for producing a quadratic field along a second axis, the axes being orthogonal;
  - wherein the first means and the second means are arranged to generate a quadratic field along a first axis and a quadratic field along a second axis by the application of a first potential at the first means and a second potential at the second means, wherein the first potential and the second potential are concurrently alternately and oppositely biased, thereby to define a plane of zero field in between the first means and the second means;
- and the assembly further comprising:
  - means defining the direction of entry of ions into the ion mirror, the defined direction of entry lying substantially in the said plane of zero field.

The ion mirror of the assembly may be an ion mirror according to the first aspect of the invention.

According to a further aspect of the invention there is provided a mass spectrometer including an ion mirror according to the first aspect of the invention or an ion mirror assembly according to the second aspect of the invention.

According to another aspect of the invention there is provided an ion trap comprising:

- a first means for producing a quadratic field along a first axis, a second means for producing a quadratic field along a second axis, a third means for producing a quadratic field along a third axis, a fourth means for producing a quadratic field along a fourth axis, the first axis, second axis, third axis and fourth axis being mutually orthogonal about a notional central axis;
- means to produce a magnetic field substantially perpendicular to each of the first axis, second axis, third axis and fourth axis at each end of the ion trap;
- wherein the first means, the second means, the third means and the fourth means are arranged such that an ion introduced between the first means, second means, third means and fourth means and the magnetic means is trappable upon application of the quadratic fields along the first, second, third and fourth axes.

In this way, a relatively low power ion trap is formed. The magnetic field improves resolution.

The ion trap preferably includes means to image ions trapped in the trap by monitoring image currents. Each magnetic means may include an end plate and the imaging means may arranged to monitor the image currents in the end plates.

Preferably, the first and third means are arranged to produce quadratic fields along the first and third axes in phase with one another and out of phase with the quadratic fields along the second and fourth axes, arranged to be produced by the second and fourth means, wherein the quadratic field produced by the first and third axes are provided by the application of a first potential at the first and third means and the quadratic field produced by the second and fourth axis are provided by the application of a second potential at the second and fourth means, wherein the first potential and the second potential are concurrently alternately and oppositely biased.

Each of the first, second, third and fourth means may be arranged to produce a hyberbolic electric field. This improves coherence.

According to another aspect of the invention there is provided a mass spectrometer including an ion trap according to the preceding aspect of the invention.

Embodiments of the invention will now be described by way of example and with reference to the accompanying drawings, in which.

Figure 5A:
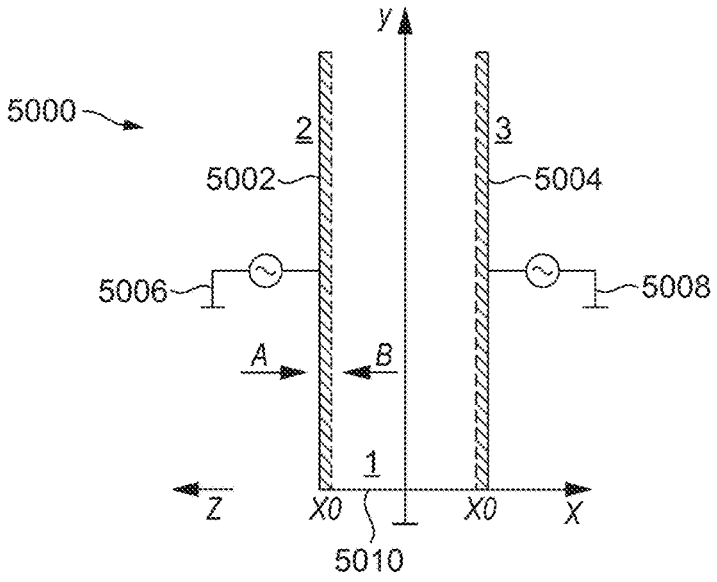
FIG. 5A is a cross sectional view of an ion mirror according to an embodiment of the invention.
Figure 5B:
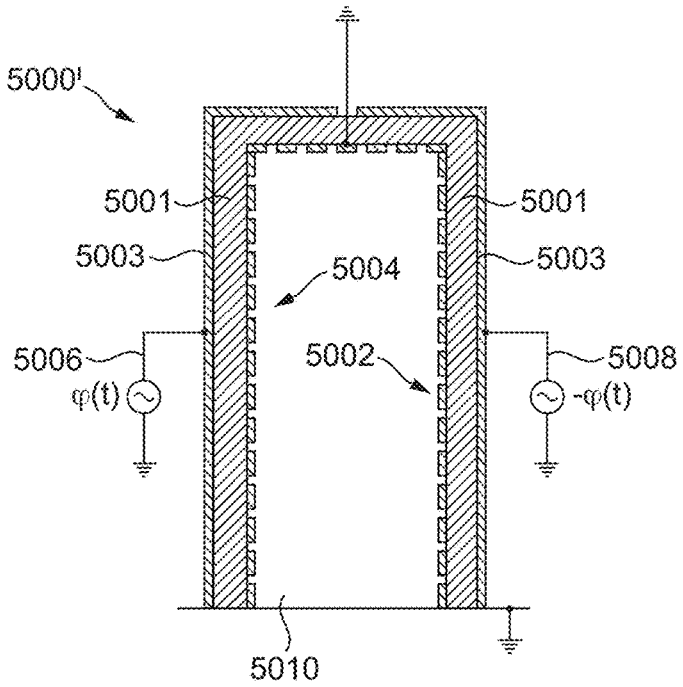
FIG. 5B is a cross sectional view of an ion mirror according to an embodiment of the invention.
Figure 5C:
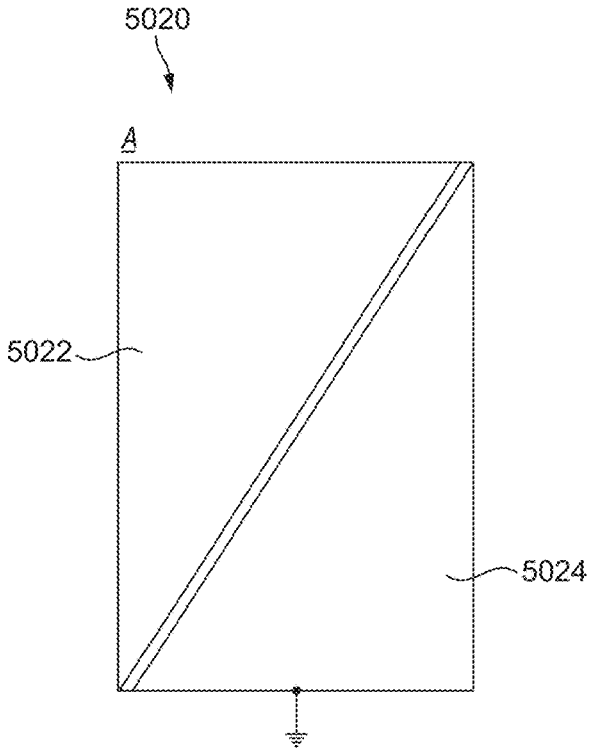
FIG. 5C is a plan view of a first face of an ion mirror electrode according to an embodiment of the invention.
Figure 5D:
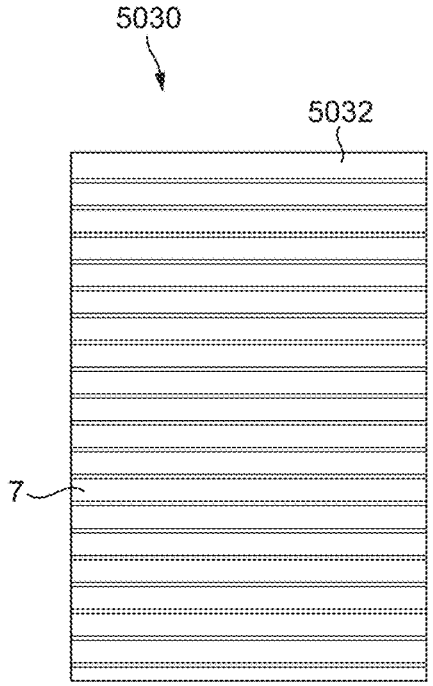
FIG. 5D is a plan view of a second face of an ion mirror electrode according to an embodiment of the invention.
Figure 5E:
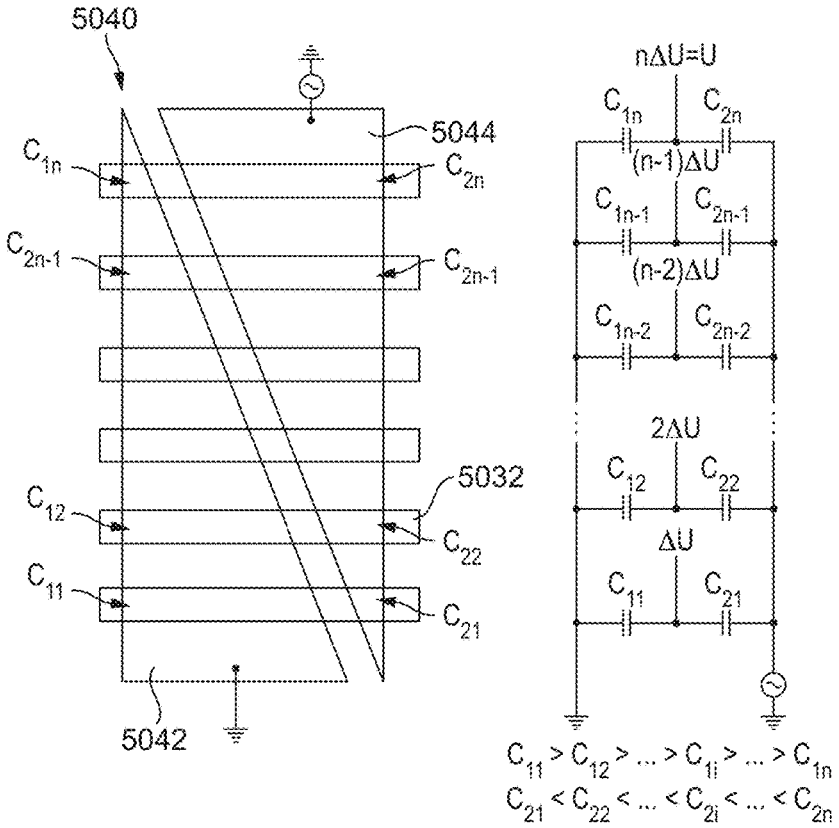
Figure 5F:
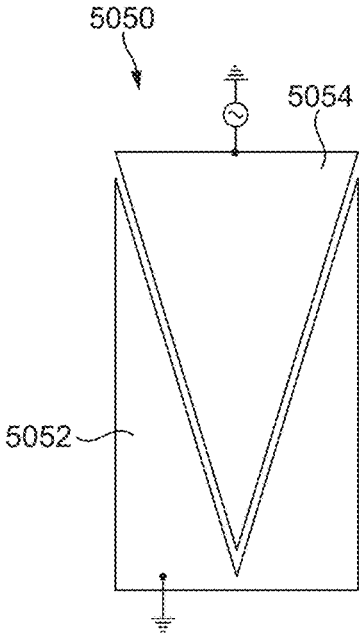
Figure 5G:
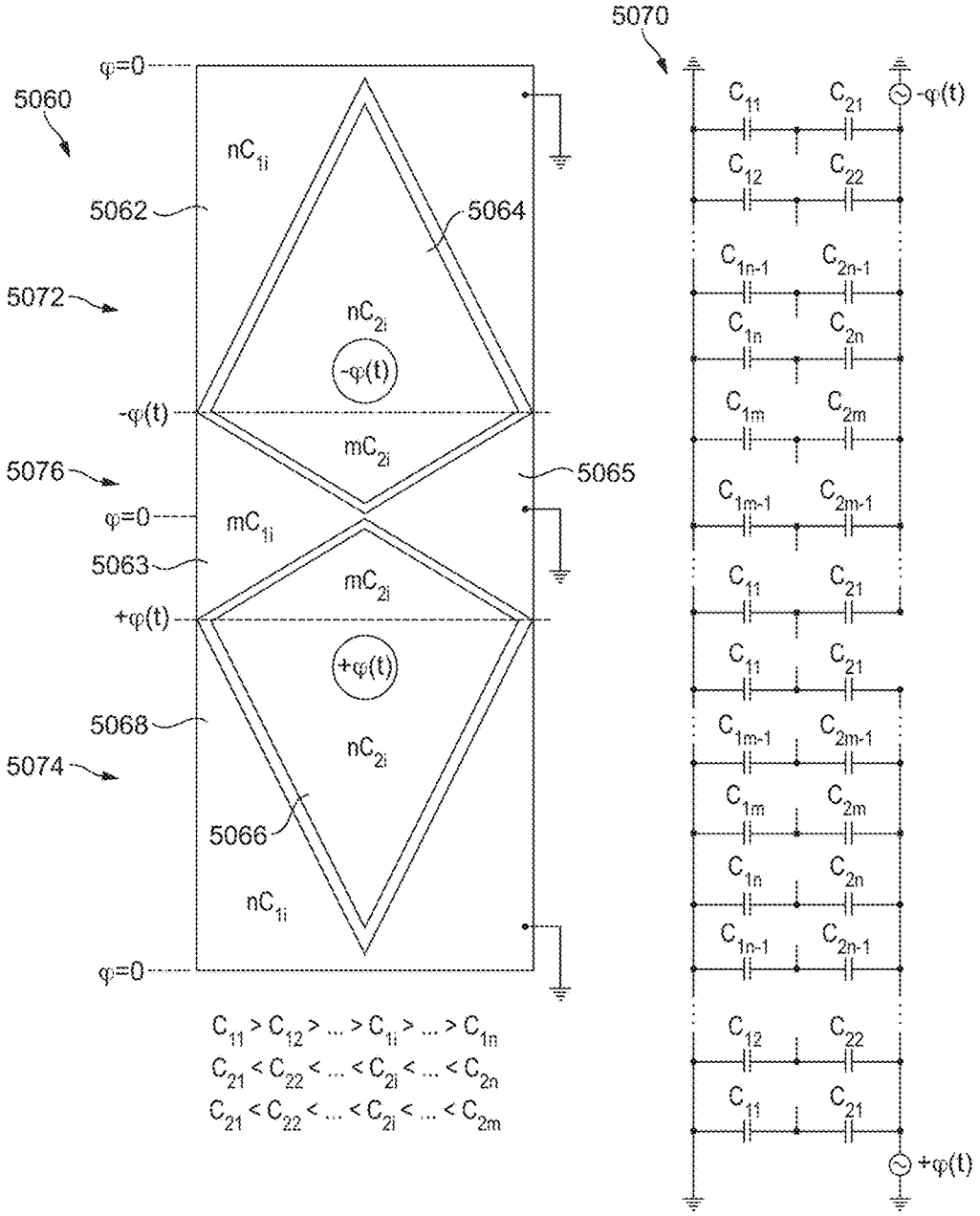
Figure 5H:
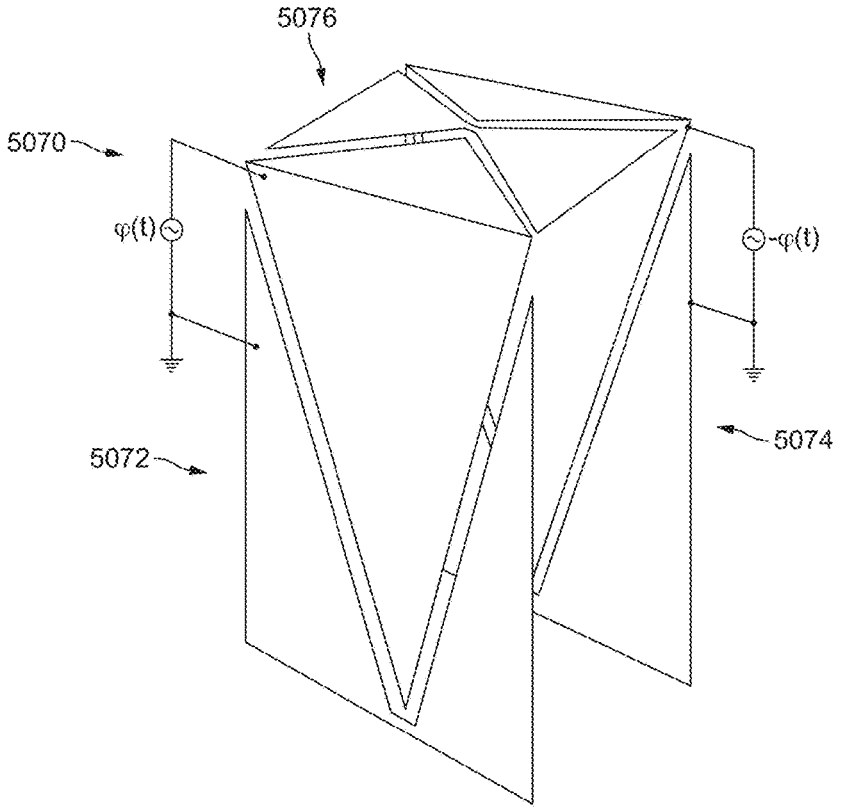
Figure 6A:
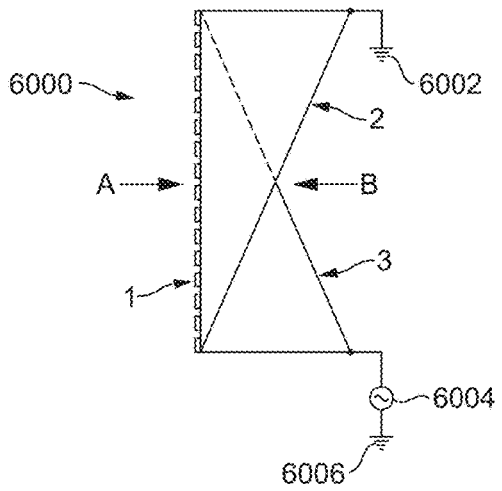
Figure 6B:
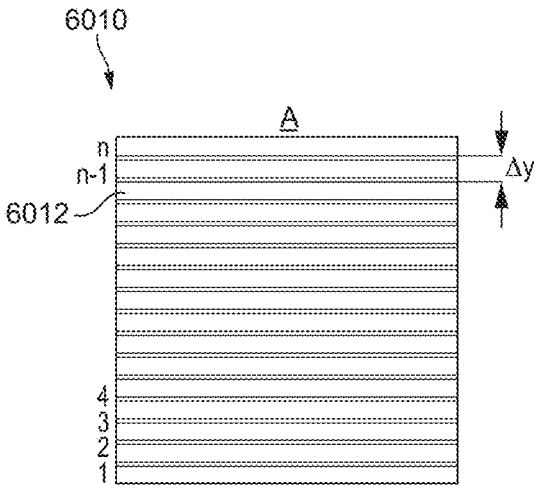
Figure 6C:
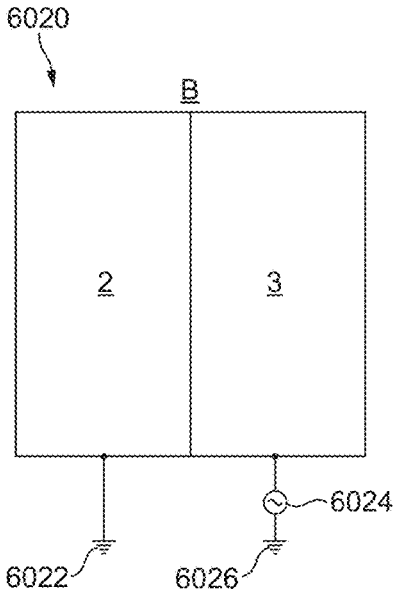
Figure 6D:
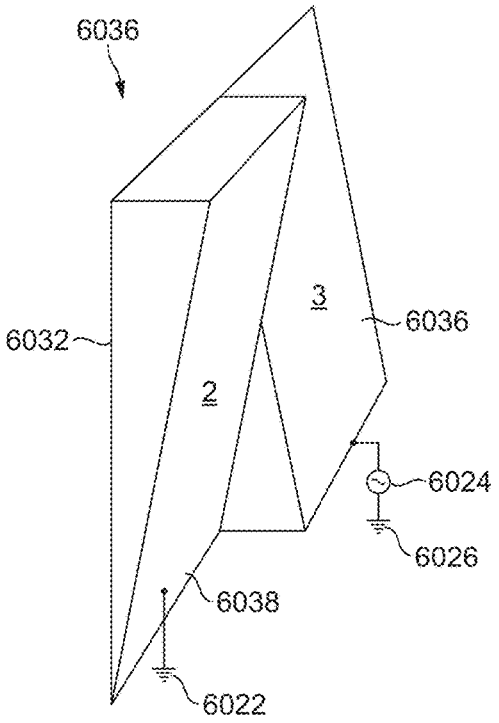
Figure 6E:
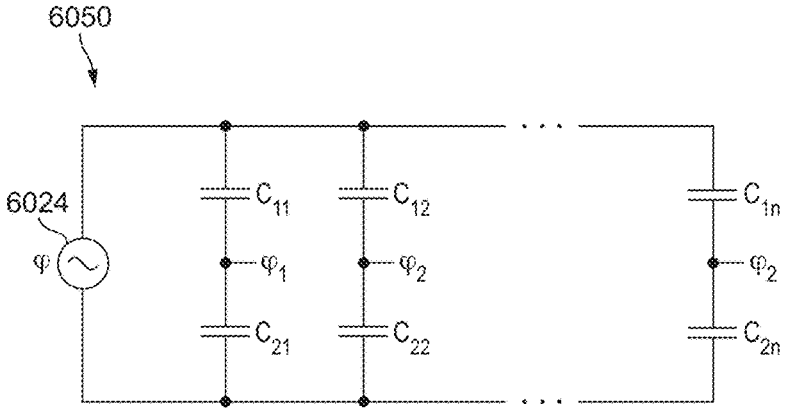
Figure 7:
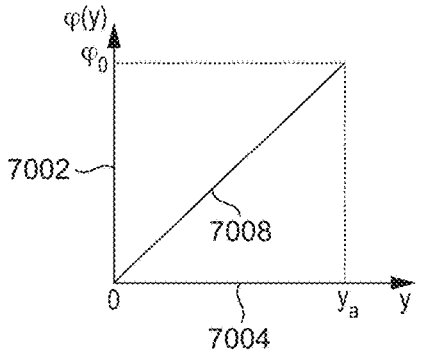
Figure 8A:
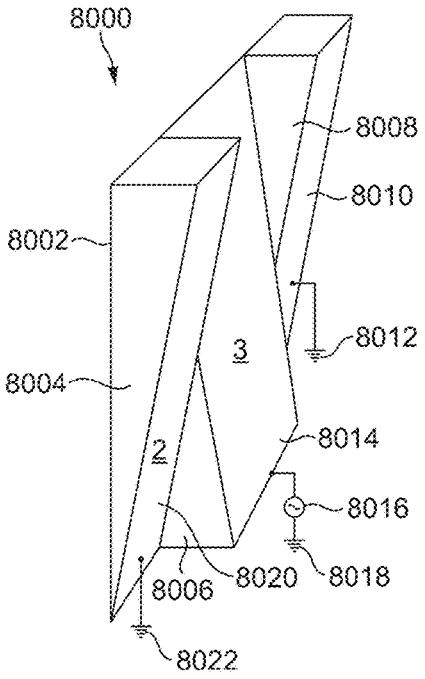
Figure 8B:
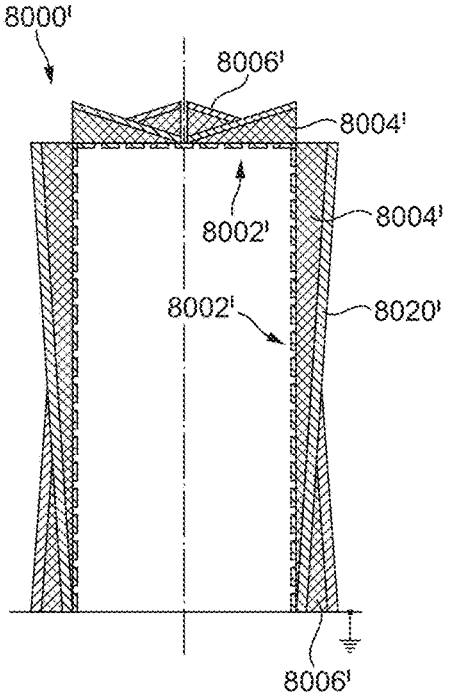
Figure 9:
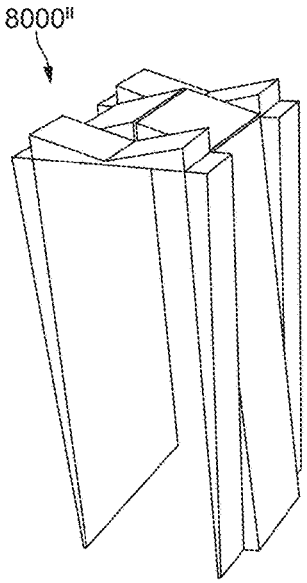
Figure 10:
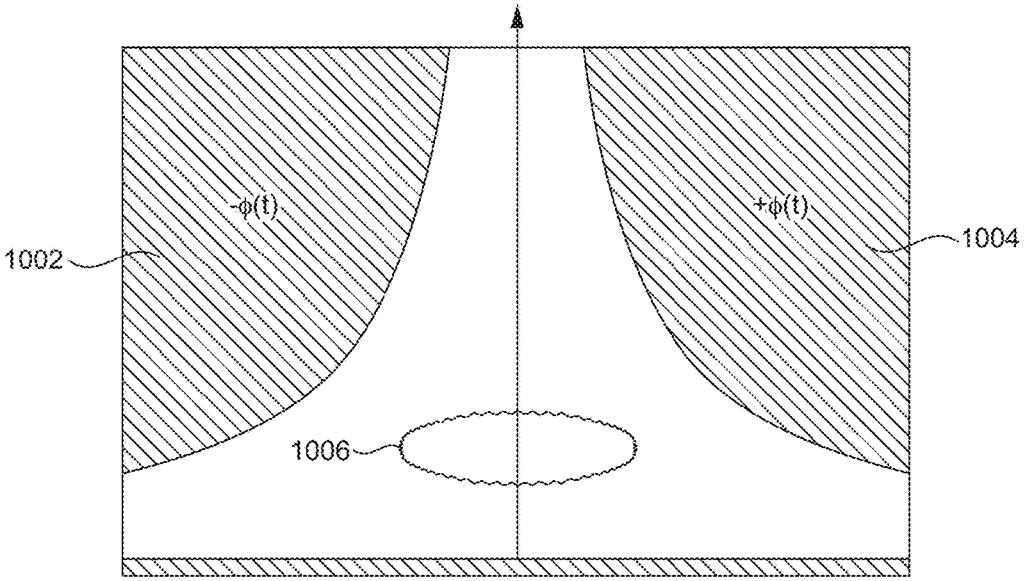
Figure 11A:
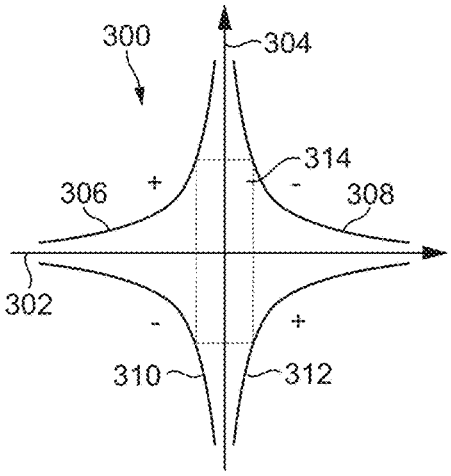
Figure 11B:
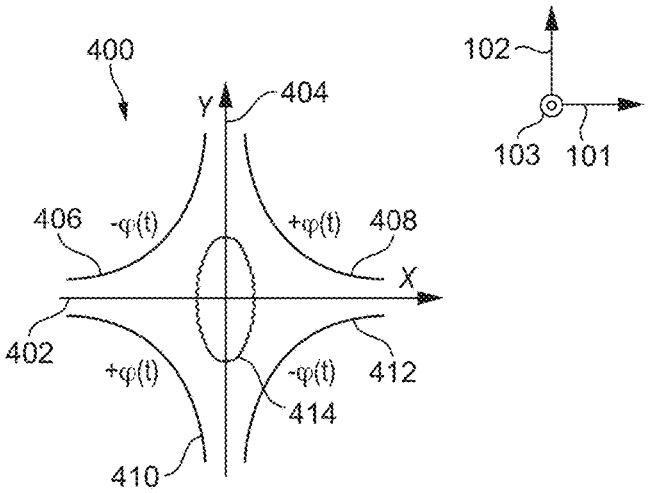
Figure 11C:
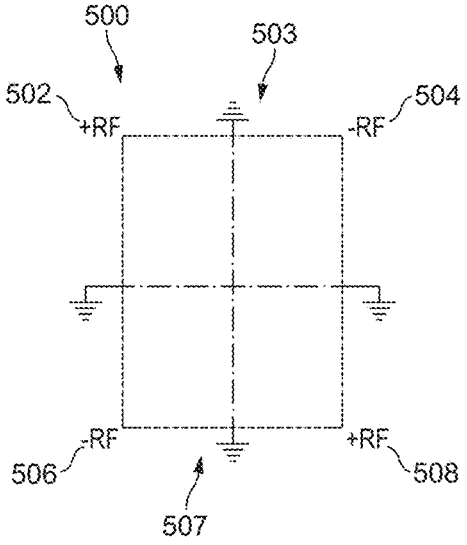
Figure 12A:
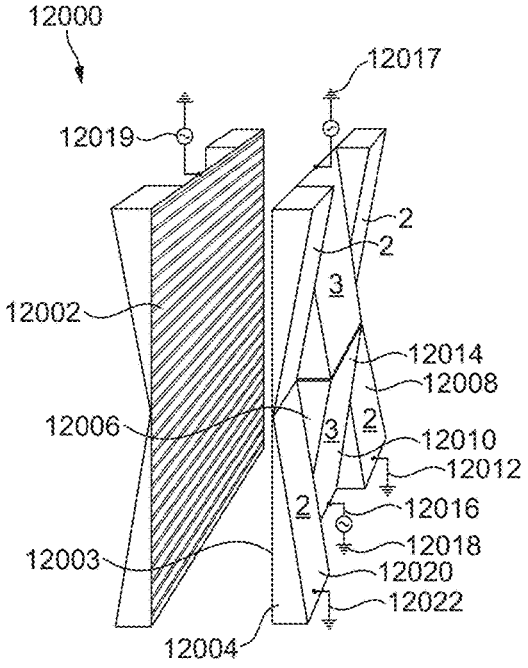
Figure 12B:
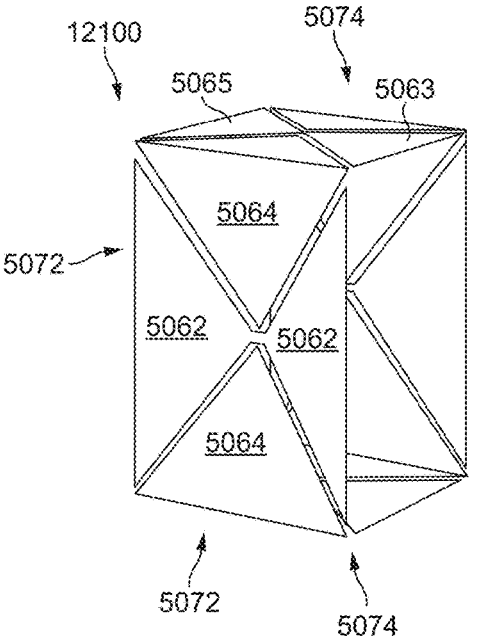
Figure 13:
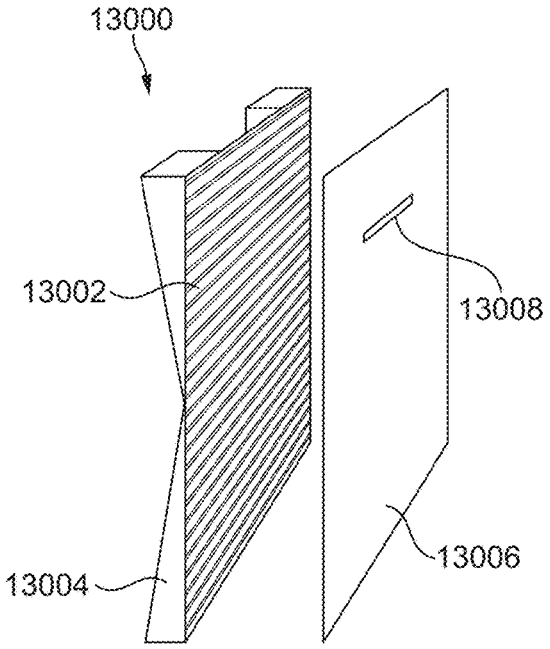
Figure 14:
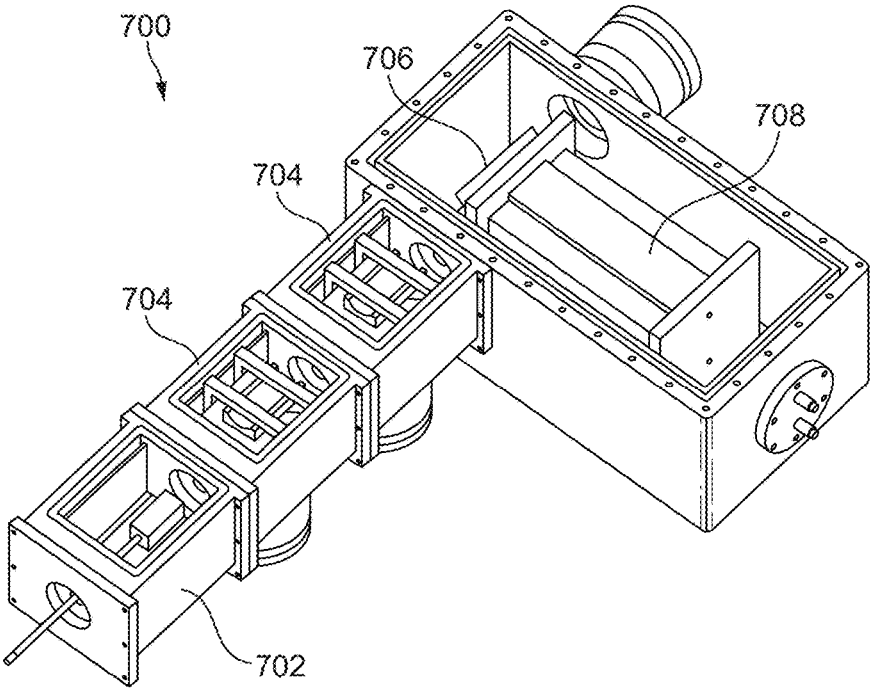
Figure 15A:
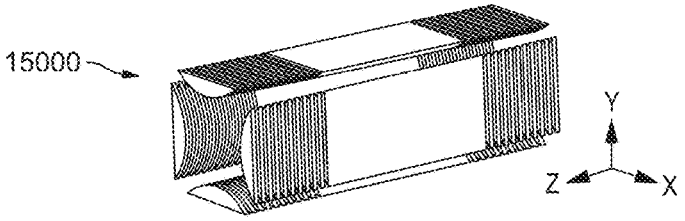
Figure 15B:
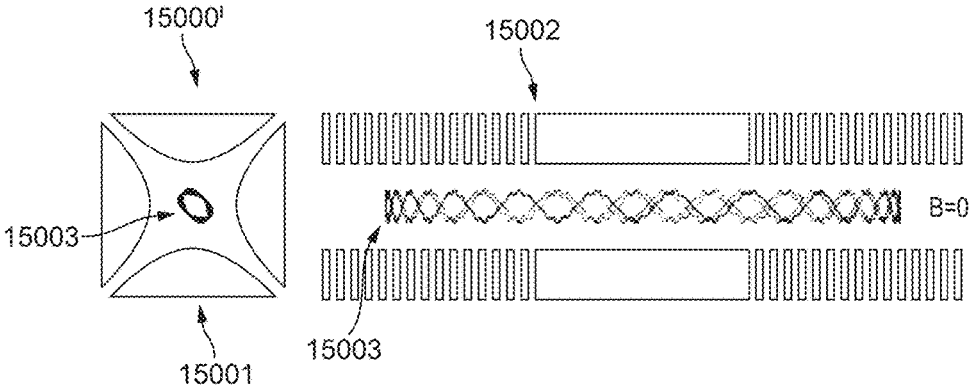
Figure 15C:
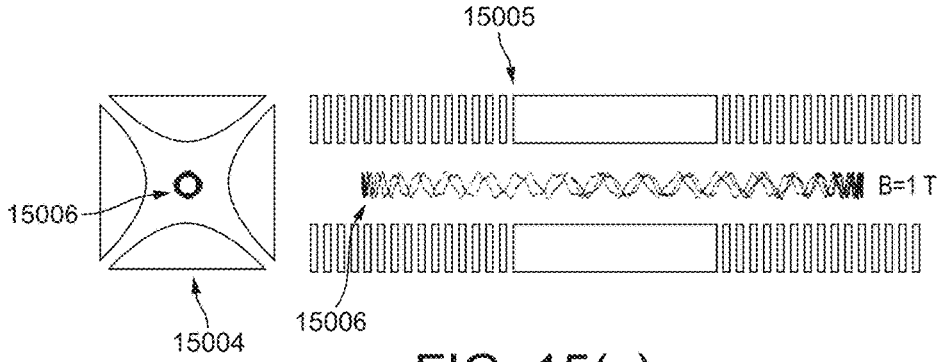
Figure 15D:
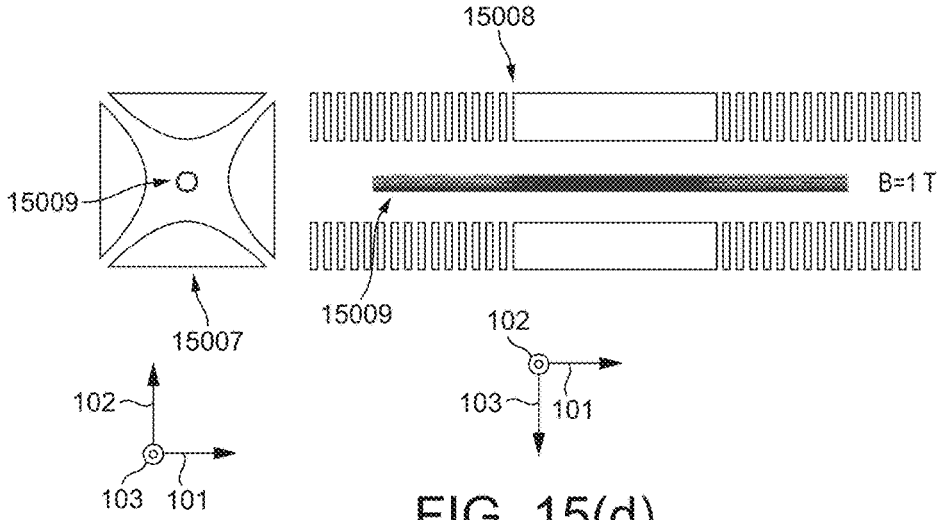

FIG. 5E a plan view of an ion mirror with a corresponding circuit diagram of a capacitive divider usable in an embodiment of the invention;

FIG. 5F is a plan view of the back electrode of an ion mirror according to an embodiment of the invention;

FIG. 5G is an exploded plan view of a back electrode arrangement and corresponding circuit diagram of a capacitive divider usable in an embodiment of the invention;

FIG. 5H is a perspective view of the back electrode arrangement of FIG. 5G;

FIG. 6A is a cross sectional view of an ion mirror electrode according to an embodiment of the invention;

FIG. 6B is a plan view of a first face of an ion mirror electrode according to an embodiment of the invention;

FIG. 6C is a plan view of a second face of an ion mirror electrode according to an embodiment of the invention;

FIG. 6D is a perspective view of an ion mirror electrode according to an embodiment of the invention;

FIG. 6E is a circuit diagram showing the effective circuit usable as a capacitive divider in an embodiment of the invention;

FIG. 7 is a graph showing the effective potential distribution along an electrode according to an embodiment of the invention;

FIG. 8A is a perspective view of an ion mirror electrode according to an embodiment of the invention;

FIG. 8B is a cross sectional view of an ion mirror electrode arrangement corresponding to the electrode of FIG. 8B;

FIG. 9 is a perspective view of the ion mirror electrode of FIG. 8B;

FIG. 10 is schematic diagram showing the trajectory of ions trapped in the structure of FIG. 9;

FIG. 11A is a cross sectional schematic diagram of a quadrupole arrangement of electrodes forming an ion trap;

FIG. 11B is a cross sectional schematic diagram illustrating ion movement in the ion trap;

FIG. 11C is a schematic diagram of an ion trap according to an embodiment of the invention;

FIG. 12A is a perspective view of a quadrupole arrangement of electrodes forming an ion trap;

FIG. 12B is a perspective view of an arrangement of electrodes forming an ion trap;

FIG. 12 C is a cross sectional view of two configurations of electrodes forming ion traps;

FIG. 13 is a perspective view of a dipole arrangement of electrodes forming an ion trap FIG. 14 is a perspective view of one possible embodiment of a time of flight mass spectrometer; and FIG. 15A is a perspective view of ion mirror electrodes in one embodiment of an ion trap and FIGS. 15B, 15C and 15D are a series of schematic diagrams showing calculated ion trajectories and quadratic-field ion mirrors with hyperbolic-shaped electrodes.

Figure 1:
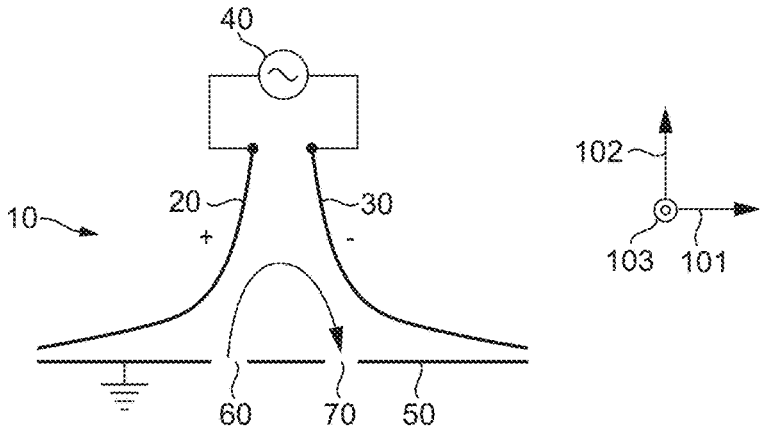
FIG. 1 is a schematic plan view in cross section of an ion mirror.

A first ion mirror is shown in FIG. 1. The ion mirror 10 comprises two electrodes 20, 30 connected to an electrical source 40. A flat plate 50 is in front of the electrodes 20, 30 and defines two apertures 60, 70, separated in the x axis direction, which form an entry aperture 60 and an exit aperture 70 for ions. The path of the ions is shown by the arrow between aperture 60 and aperture 70 in FIG. 1. The plate 50 is grounded. The electrodes 20, 30 and plate 50 are elongate and are seen in transverse cross section. The elongate axes of the electrodes 20, 30 are parallel.

Figure 3A:
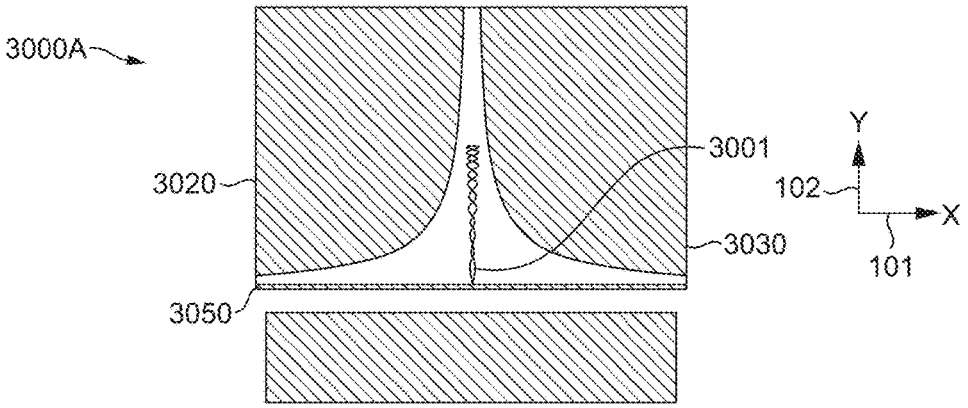
FIG. 3A is a schematic cross sectional view of an ion mirror according to the first embodiment of the invention.
Figure 3B:
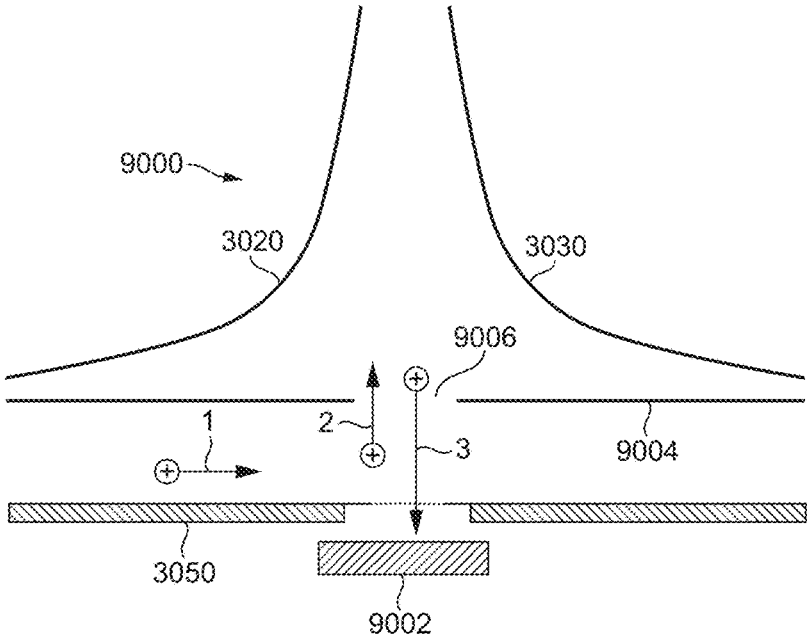
FIG. 3B is schematic showing the introduction of ions into the ion mirror according to the first embodiment of the invention.

FIG. 3B shows an arrangement according to an embodiment of the invention, which is similar to the ion mirror of FIG. 1, but the entry aperture 60 and exit aperture 70 are separated in the z axis direction, and the apertures 60, 70 lie in the middle plane of zero field.

In use, electrode 20 and electrode 30 are connected to an alternating electric current source, such that the electrodes 20, 30 are concurrently oppositely biased, one positively, one negatively. The alternating current supplied to the electrodes 20, 30 causes them to alternately temporally bias out of phase with one another. A charged ion that is accelerated towards the ion mirror 10 is affected by the oscillating electric field generated by the alternating current between the electrodes 20, 30. For the purpose of describing the relevant aspects of the drawings, axes 101, 102, 103 are shown, which show the direction of the x-axis 101, the y-axis 102 and the z-axis 103, which is perpendicular to the x-axis 101 and the y-axis 102 (the x-axis 101 and y-axis 102 are also perpendicular to one another).

The electrodes 20, 30 are made from a conducting material, such as a metal. The plate 50 is constructed from stainless steel.

An ion entering the mirror is affected by the oscillating electric field, it will effectively be attracted and repelled by the oscillating field, whilst subjected to perpendicular electric field components generated by the geometrical arrangement of electrodes, with an overall effect that it more slowly passes along its trajectory (entering and exiting the mirror, or entering and becoming trapped) and takes a longer path length to do so than if simply deflected by the ion mirror. The increased path length results in improved resolution of a time of flight mass spectrometer, because the differences in the mass-charge ratios are more easily distinguished due to higher deflection distances.

Figure 2:
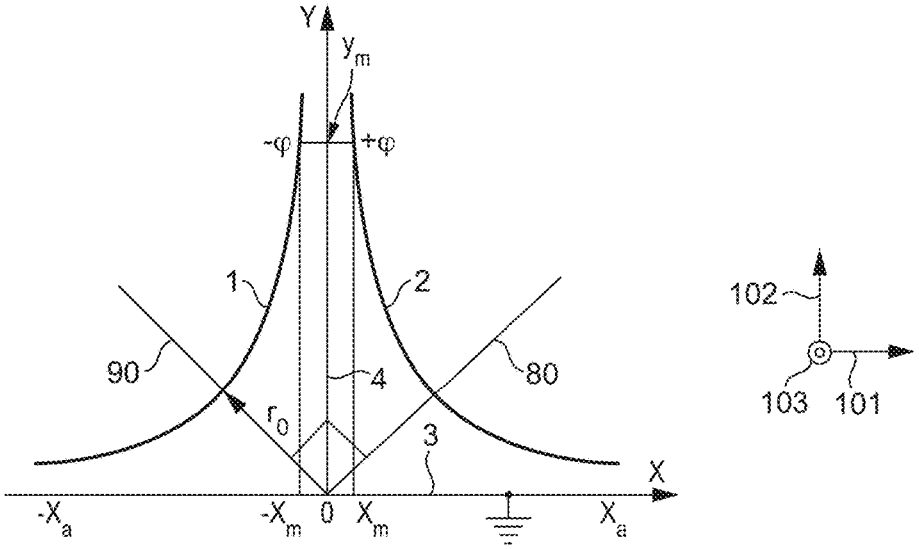
FIG. 2 is a schematic showing the electric field of the ion mirror of the first embodiment.

FIG. 2 shows lines depicting cross-sections of surfaces of constant electric potential generated by the electrodes 20, 30. The electrodes 20, 30 are curved sheets as shown in FIG. 1. Each electrode 20, 30 generates a hyberbolic field potential as shown in FIG. 2. Each field potential 1, 2 is symmetrical about an axis 80, 90. The axes 80, 90 of the field potentials 1, 2 are orthogonal. The electrodes 20, 30 and their fields are symmetrical about a vertical plane through the y-z axes in FIG. 2. This means that there is a zero field potential plane which corresponds to the y-z plane. The ions will be reflected if they approach the mirror along a direction in the y-z plane if they are introduced at an angle to the x-y plane, in which case the entry aperture and exit aperture are offset along the z-axis. The ions are also reflected if they enter along a direction which is the y-z plane, upon application of an increasing electric field. In this case, there is a dynamic deflecting field, which sends an ion on a trajectory that is reflected rather than passing along the plane of zero field.

The ion mirror 10 of the embodiment does not reflect the ions straight back along the same path, like the known quadratic ion mirror, but instead subjects the ions to sideways forces as well as the reflecting force. In other words, using the axes shown in FIGS. 1 and 2, the ions are subjected to forces in both the x-axis 101 and y-axis 102 direction, not just the y-axis 102 direction.

The fact that the ions are subjected to sideways forces as well as the reflecting force optimizes sensitivity in practical analysis in the time of flight mass spectrometer.

Although the ions are shown approaching the ion mirror parallel to the y-z plane, the ion trajectory could be at an angle to the y-z plane in a variant of the embodiment and the apertures 60, 70 may overlap at a central position, thereby to form an aperture through which ions enter and leave the ion mirror 10. Further, the apertures 60, 70 may be offset along the z-axis, but still be centrally placed between the electrodes 20, 30.

Whilst the plate 50 is typically made of stainless steel, in further examples, the plate 50 may be constructed from other conducting materials.

FIGS. 3A, 3B, 3C and 3D are schematic drawings showing an ion mirror according to an embodiment of the invention. Each of the FIGS. 3A, 3B, 3C and 3D show the corresponding axes of reference, to indicate the relative orientation of each of the schematic drawings. FIG. 3A shows a first view 3000A of an ion mirror comprising a first electrode 3020, a second electrode 3030 and a grounded plate 3050. FIG. 3A is analogous to FIG. 1. However, in contrast to FIG. 1, the entrance and exit of ions into the ion mirror does not occur either side of the central point at x=0 along the x-axis 101, as shown in FIG. 1, by entrance aperture 60 and exit aperture 70. Rather, ions enter the ion mirror 3000A at an entrance aperture at x=0 and exit the ion mirror at an exit aperture at x=0, centrally located along the z-axis 103, between the first electrode 3020 and the second electrode 3030.

In use, electrode 3020 and electrode 3030 are connected to an alternating electric current source, such that the electrodes 3020, 3030 are concurrently oppositely biased, one positively, one negatively. The alternating current supplied to the electrodes 3020, 3030 causes them to alternately temporally bias out of phase with one another. A charged ion that is accelerated through an aperture in the grounded plate 3050 towards the ion mirror 3000A is affected by the oscillating electric field generated by the alternating current between the electrodes 3020, 3030. For the purpose of describing the relevant aspects of the drawings, axes 101, 102, 103 are shown, which show the direction of the x-axis 101, the y-axis 102 and the z-axis 103, which is perpendicular to the x-axis 101 and the y-axis 102 (the x-axis 101 and y-axis 102 are also perpendicular to one another). The ions entering the mirror are subject to varying electric and magnetic fields and accordingly have a trajectory 3001 that oscillates to and from a parabolic path entering the ion mirror 3000A and leaving the ion mirror 3000A. The ions are introduced to the ion mirror 3000A at x=0 and leave the ion mirror 3000A, upon reflection, at x=0. However, the ion trajectory 3001 is such that the ions are displaced along the z-axis 103 at x=0.

FIG. 3B is a schematic of apparatus 9000 in a further embodiment of the invention. FIG. 3B illustrates how ions are introduced and monitored in using the ion mirror 3000A described in relation to FIG. 3A. In FIG. 3B there is shown a grounded plane electrode 3050 having an aperture 9006. There is also shown a first electrode 3020 and a second electrode 3030. In use, ions are injected into the apparatus through the aperture 9006 in the grounded plate 3050. The path of ions is labelled 1, 2 and 3. The ions pass in the initial direction 1, substantially parallel to the grounded electrode 3050. The ions are deflected into the ion mirror through aperture 9006, in direction 2. The ions are reflected in direction 3 and detected by detector 9002. An alternating current is applied to the electrodes 3020, 3030, thereby creating an oscillating electric field between the electrodes 3020, 3030 and grounded plate 3050. The oscillating electric field may be supplemented with a static electric field, applied between the grounded plate 3050 and the electrodes 3020, 3030, thereby to trap ions entering into the apparatus 9000. The electric field is applied such that ions undergo oscillatory movements between the grounded plate 3050 and the electrodes 3020, 3030.

Figure 3C:
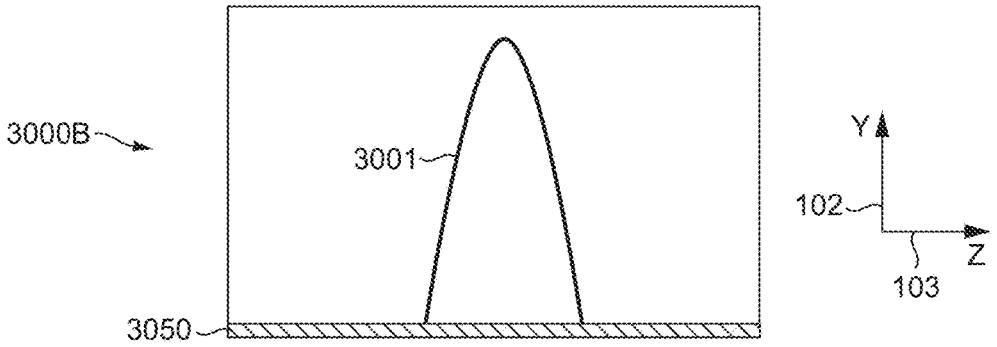
FIG. 3C is a schematic side view of the ion mirror of FIG. 3A.

FIG. 3C shows a second view 3000B of the ion mirror described with reference to FIG. 3A. There is shown a grounded plate 3050 and the trajectory 3001 of ions entering the ion mirror 3000B through one aperture (not shown) and exiting the ion mirror 3000B through another aperture (not shown). The ions are displaced along the z-axis 103, but enter and exit the ion mirror 3000B at x=0.

Figure 3D:
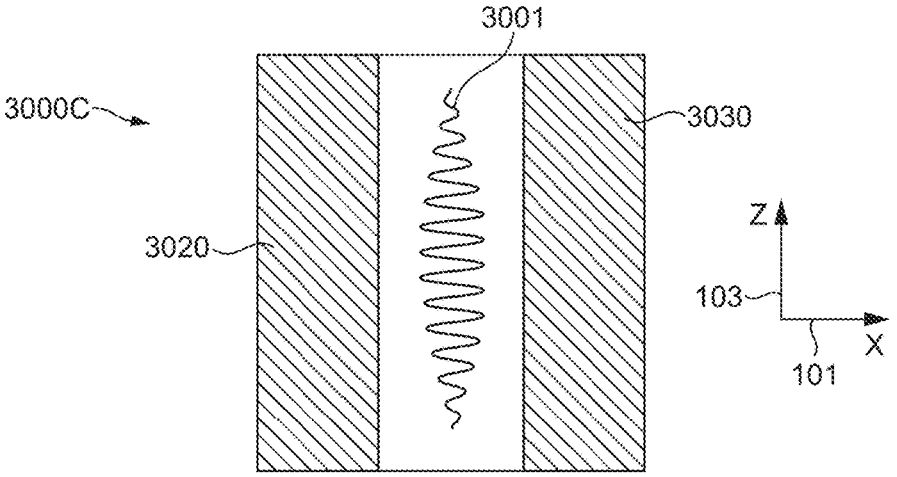
FIG. 3D is a schematic plan view of the ion mirror of FIGS. 3A and 3B.

FIG. 3D shows a plan view 3000C of the ion mirror described with reference to FIGS. 3A and 3B. There is shown the trajectory 3001 of ions through the ion mirror 3000C and the first electrode 3020 and the second electrode 3030. It is shown that, in use, the ion trajectory 3001 is such that the ions enter and exit the ion mirror 3000C at x=0 and are displaced along the z-axis 103 where they exit the ion mirror at x=0. The oscillating electric field that is applied to the first electrode 3020 and the second electrode 3030 creates an extended path length for the ions, which leads to greater sensitivity of the ion mirror 3000C.

Figure 4A:
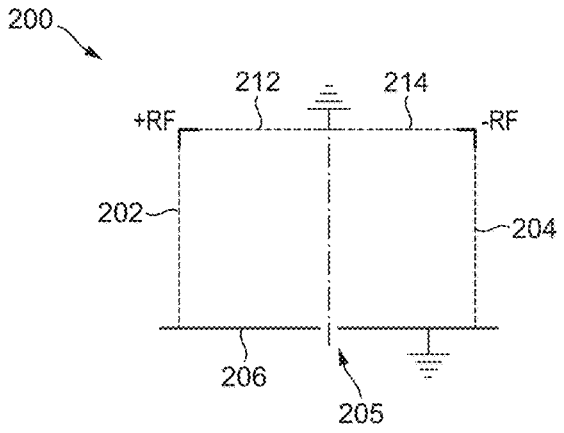
FIG. 4A is a schematic diagram of an ion mirror according to a second embodiment of the invention.

FIG. 4A is a schematic showing an ion mirror 200 according to a second embodiment of the invention, in which the ion mirror 200 is formed from parallel electrodes 202, 204. In contrast to the ion mirror of FIG. 1, there is shown only a single entry and exit aperture 205. The entry and exit aperture 205 is equidistant between the electrodes 202, 204 (i.e. at x=0). A charged particle enters the mirror by passing through the aperture 205 and exits the mirror by passing out through the aperture 205. The entry of ions can be at an angle that is inclined with respect to the y-axis 102, or it can be parallel to the y-axis 102, since there will be components of motion parallel to the x-axis 101 which result from application of an oscillating field between the electrodes 202, 204, when the ion has entered the ion mirror 200. The electrodes 202, 204, form a box like structure, with substantially parallel sides that are substantially perpendicular to the ground plate 206 and an end cap formed by portions 212, 214 of the electrodes 202, 204 respectively, substantially parallel to the ground plate 206. A substantially perpendicular bend in each of the electrodes 202, 204 means that the end cap portions 212, 214 can be juxtaposed, but not in contact, to form a box. Beneficially the path of the ion through the mirror is significantly extended in comparison to a traditional ion mirror, thereby improving in resolution when used in conjunction with a time of flight mass spectrometer.

Figure 4B:
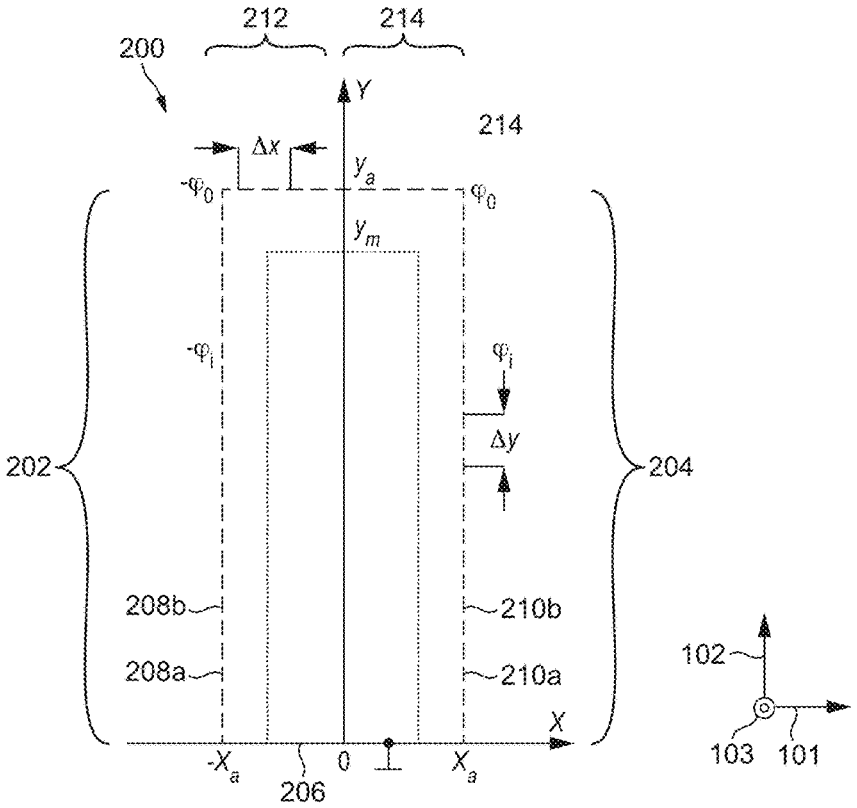
FIG. 4B is a schematic diagram of an ion mirror according to an embodiment of the invention.

FIG. 4B is a schematic plan view in cross-section of an ion mirror 200 according to an embodiment of the invention. There is shown a ground plate 206 analogous to plate 50 of ion mirror 10. The ground plate 206 is perpendicular to axis y 102 and contains apertures for the entrance and exit of ions (apertures not shown). Substantially perpendicular to a ground plate 206 and extending from adjacent therefrom there is a first system of plane electrodes 202, comprising a main part, and a cap part 212 that is opposite and substantially parallel to the ground plate 206. Parallel to the main part of the system of plane electrodes 202, there is a second system of plane electrodes 204, which is similarly arranged with a main part and a bend to provide a cap part 214 that is opposite and substantially parallel to the ground plate 206. The main parts of the first and second systems of plane electrodes 202, 204 are equidistant from a central axis (the y axis), at distances $-x_a$ and $+x_a$ respectively on the sides that are parallel and opposite one another. The first and second systems of plane electrodes 202, 204 form substantially planar electrode systems parallel to the y-z plane. The first and second systems of plane electrodes 202, 204, are arranged to form substantially parallel sides that are substantially perpendicular to the ground plate 206, as well as an end cap 212, 214 substantially to the ground plate 206. A substantially 90 degree bend in each of the electrodes 202, 204 means that they can be juxtaposed, but not in contact, to form a box.

The first and second systems of plane electrodes 202, 204 each comprise numerous discrete elongate electrodes 208*a*, 208*b*, 210*a*, 210*b* (only four discrete elongate electrodes are labelled, however, more are shown in the example of FIG. 4) wherein the long axis of the discrete elongate electrodes 208*a*, 208*b*, 210*a*, 210*b* lies substantially parallel to the Z axis 103. In practice, an alternating current is applied to the first and second systems of plane electrodes 202, 204, such that first and second systems of plane electrodes are oppositely biased, one positively, one negatively. The alternating current supplied to the electrodes 202, 204 causes them to alternately temporally bias out of phase with one another, such that they have opposite polarities at all times.

Further, the potential at each of the one or more discrete elongate electrodes 208*a*, 208*b*, 210*a*, 210*b* of each of the first and second systems of plane electrodes 202, 204 is predetermined. Capacitive coupling predetermines the value of the potential at each of the discrete elongate electrodes 208*a*, 208*b*, 210*a*, 210*b* of each of the first and second systems of plane electrodes 202, 204. Accordingly, whilst the polarity of each of the discrete elongate electrodes 208*a*, 208*b* of the first system of plane electrodes 202 is the same and opposite to the polarity of the discrete elongate electrodes 210*a*, 210*b* of the second system of plane electrodes 204, the electric potential at a first discrete elongate electrode 208*a* of the first system of plane electrodes 202 is determined separately from a second discrete elongate electrode 208*b* of the first system of plane electrodes 202.

The effective use of a capacitive divider allows the potential of each discrete elongate electrode 208*a*, 208*b*, 210*a*, 210*b* to increase along the y-axis. The potential may increase linearly along the y-axis 102 upon appropriate selection of capacitance. The potential further increases linearly along the x-axis 101 for each of the system of electrodes 202, 204, at the portion of the electrode system 202, 204 that is substantially parallel to the ground plate 206 i.e. end cap portion 212 as part of the system of electrodes 202 and end cap portion 214 as part of the system of electrodes 204. Hence, the potential along the side walls 202, 204 and the end cap 212, 214 is linear. Subsequently, charged ions entering the ion mirror 200 are subjected to an approximation of the forces generated by hyperbolic electrode ion mirror 100, thereby being reflected by the ion mirror 200 in a similar way to that described above in relation to ion mirror 100. Therefore, any ion entering the ion mirror 200 through a hole in grounded plate 206, which ion has a trajectory that enters the ion mirror 200 at y=0 and x=0 (equidistant between the systems of plane electrodes 202, 204) and is not parallel to the y-z plane, or any ion which has a trajectory that is not parallel to the y-z plane, or any ion which has a trajectory that is parallel to the y-z plane, but which enters 'off axis' (i.e. not at the equidistant point x=0 between the equally biased electrodes with differing polarities), or any ion that enters at x=0, but exits at a point offset in the z direction, or any ion that enters under application of a suitably asymmetric oscillating electric field results in the ion being reflected due to the forces imparted by the electric field components in the z, y and x directions.

Figure 4C:
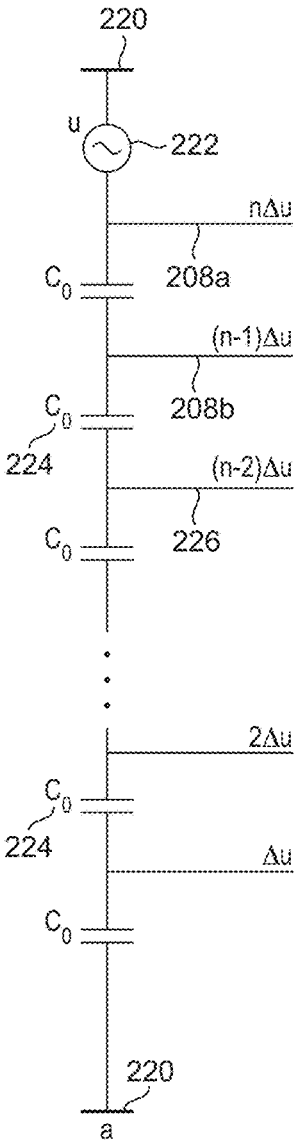
FIG. 4C is a circuit diagram of a portion of a capacitive divider which the electrodes of the ion mirror inherently constitute and which controls values of potentials in an embodiment of the invention.

FIG. 4C shows a circuit diagram illustrating a portion of a capacitive divider which electrodes 208*a*, 208*b*, 20*a*, 210*b* and others comprise and which controls provision of varying potential along the systems of plane electrodes 202, 204 and 212, 214. Further descriptions of capacitive dividers are given below with reference to FIGS. 5A to 5H. There is shown an alternating current source 222 that is connected to ground 220. The alternating current source 222 is connected to a series of effective capacitors 224 that are created between discrete elongate electrodes 208, a dielectric material and a metallised back electrode. Where the capacitances 224 are equal, there is a discrete-linear potential distribution of potentials 226.

The alternating electric field generated by altering the polarity of the first and second systems of plane electrodes results in forces being applied to the moving charged particles (ions) entering the mirror. The forces can be controlled by altering the applied potential and by altering the frequency of the applied electric field, such that selective resonant oscillation of the charged particles may be achieved. Such oscillation provides the benefit of a helical path and hence increased path length. The increased path length leads to better resolution of a time of flight mass spectrometer. Further, the sensitivity of the apparatus is not reduced because the path length is not simply increased, but rather the angular momentum of specified charged particles in the electric field is accentuated for increased sensitivity of detection.

FIGS. 5A, 5B, 5C, 5D, 5E, 5F, 5G and 5H show an alternative construction of the systems of plane electrodes 202, 204. In FIG. 5A there is shown a cross sectional view of two parallel systems of plane electrodes 5002, 5004, which form an ion mirror 5000. The ion mirror 5000 further comprises a grounded plate electrode 5010. The grounded plate electrode 5010 has an aperture (not shown) for the entry and exit of ions into the ion mirror 5000 and out of the ion mirror 5000. Each system of plane electrodes 5002, 5004 is respectively connected to a grounded alternating current source 5006, 5008.

FIG. 5B shows a schematic of an alternative construction of the ion mirror 5000. There is shown an ion mirror 5000'. The ion mirror 5000' comprises a first system of plane electrodes 5002 and a second system of plane electrodes 5004. The first system of plane electrodes 5002 comprises discrete elongate electrodes. The second system of plane electrodes 5004 comprises discrete elongate electrodes. The first system of plane electrodes 5002 is arranged to form a side wall substantially perpendicular to the ground plate 5010 as well as half of an end cap substantially parallel to the ground plate 5010. The second system of plane electrodes 5004 is arranged to form a side wall substantially perpendicular to the ground plate 5010 as well as half of an end cap substantially parallel to the ground plate 5010. This arrangement is shown in FIG. 5B to form a box-like structure, where the first system of plane electrodes 5004 and the second system of plane electrodes are positioned next to one another. The first system of plane electrodes 5002 and the second system of plane electrodes are formed on the inner surface of a dielectric material 5001. The outer surface of the dielectric material 5001 is a metallised electrode 5003. The metallised electrode 5003 associated with the first system of plane electrodes 5002 is connected to an alternating current power source 5006 and the metallised electrode 5003 associated with the second system of plane electrodes 5004 is connected to an alternating current power source 5008. The use of dielectric material 5001 between the system of plane electrodes 5002, 5004 and creates effective capacitors, which can be used to form a capacitive divider, as described in relation to FIGS. 4C and 5E. In use, the ion mirror 5000' is used in the manner described in relation to FIGS. 3 and 4.

The rear side of an electrode system 5002 as described with reference to FIG. 5A is shown at FIG. 5C. There are shown two electrodes 5022, 5024, which do not touch each other and are separated by a gap. One electrode 5022 is connected to ground 5042. The other electrode 5024 is connected to an alternating current source 5046. On the front side of the electrode system 5002 as described in relation to FIG. 5A, shown at FIG. 5D, there is a series of discrete elongate electrodes 5032. The discrete elongate electrodes 5032 run parallel to the z-axis 103. Sandwiched between the rear side of the electrode system 5002 and the front side of the electrode system 5002, there is a dielectric material. The dielectric material is ceramic. Accordingly, the two electrodes 5022, 5024 effectively provide two capacitors for each of the discrete elongate electrodes 5032, provided by the electrode 5032, the dielectric material and the rear electrodes 5022, 5024. In use, the two capacitors per discrete elongate electrode 5032 form a capacitive divider.

FIG. 5E is an example of the system of plane electrodes 5002 described above with reference to FIGS. 5C and 5D and a corresponding circuit diagram illustrating the effective wiring of each of the systems of plane electrodes 5002, 5004, shown in FIGS. 5A to 5D. There is shown a system of plane electrodes 5040 formed by two triangular portions 5042, 5044. The two triangular portions 5042, 5044 are dielectric material metallised on the back side. On the front side of the dielectric material, there are discrete elongate electrodes 5032 that connect both of the two triangular portions 5042, 5044. The electrodes on the front and the back of the dielectric material are electrically equivalent with the circuit diagram of FIG. 5E, thereby to provide an electrode for an ion mirror. The circuit diagram shows a series of parallel capacitors, which provide potential at each of the discrete elongate electrodes 5032.

FIG. 5F is an alternative embodiment of the system of plane electrodes described with reference to FIG. 5E. There is shown an system of plane electrodes 5050 comprising two shaped dielectric materials 5052, 5054 that are metallised on a back side and have a front side (not shown) on which discrete elongate electrodes can be arranged to bridge and contact both of the shaped dielectric materials 5052, 5054. Advantageously, the arrangement of a triangular dielectric material 5054 and a complementary v-shaped dielectric material 5052 provides effective capacitances that vary from one discrete elongate electrode to the next whilst using dielectric material of constant thickness. The complementary dielectric materials may be of any shape that provide an effective capacitances that provide, in use, an electric field that can be used to control the flight of ions through an ion mirror or in an ion trap.

FIG. 5G is a further alternative embodiment of the system of plane electrodes 5060 described with reference to FIG. 5E and a corresponding circuit diagram. However, in contrast to FIG. 5E, the discrete elongate electrodes of the first and second systems of plane electrodes, are not shown. Rather, the dielectric material that is metallised to form a back electrode when arranged in a folded configuration and when the discrete elongate electrodes are applied is shown in an exploded plan view. There is shown a first electrode 5072, a second electrode 5074 and an end cap 5076 formed from portions of dielectric material 5063, 5065 and from partial portions of dielectric 5064, 5066. The portions of dielectric material 5062, 5064 form a first electrode 5072, portions of dielectric material 5066, 5068 form a second electrode 5074. The first electrode 5072, the second electrode 5074 and the end cap 5076 form an ion mirror. The dielectric materials forming the first and second electrodes 5072, 5074 and the end cap 5072 have metallised back electrodes are folded from the view shown in FIG. 5G to the configuration shown at FIG. 5H. There are discrete elongate electrodes arranged to bridge the dielectric sections to form effective capacitive dividers, in an analogous fashion to that described with reference to FIGS. 5A to 5H.

FIGS. 6A, 6B, 6C, 6D and 6E show an alternative construction of the systems of plane electrodes 202, 204 and 5002, 5004, which are usable to form an ion mirror, as described above. In FIG. 6A there is shown a cross sectional view of a system of plane electrodes 6000. There is shown a front view 6010 at FIG. 6B and a rear view 6020 at FIG. 6C. FIG. 6B shows a series of discrete elongate electrodes 6012. As seen at FIG. 6A, there are two prism dielectric materials 2, 3, parallel to one another. Prism material 2 has its thin end adjacent to the thick end of prism material 3 and its thick end adjacent to the thin end of prism material 3.

As shown at FIG. 6C, prism material 2 has a conducting layer on its rear side and is connected to ground 6022 and prism material 3 has a conducting layer on its rear side and is connected to a grounded alternating current source 6024. Similarly to the arrangement shown in FIGS. 5A to 5D, the distinct prism materials 2, 3 effectively provide two capacitors per discrete elongate electrode 6012.

The arrangement of system of plane electrodes 6000 FIGS. 6A, 6B and 6C is shown in a perspective view 6030 at FIG. 6D. There are shown two prism dielectric materials 2, 3, which comprise distinct conducting layers 6036, 6038 on the rear side of each of the prism dielectric materials 2, 3 respectively. On the front side 6032 of the system of plane electrodes 6000 there are discrete elongate electrodes 6012 that span both of the prism dielectric materials 2, 3. As a result, each discrete elongate electrode 6012 is separated from a conducting layer 6038 by the dielectric material of one prism material 2 and from the conducting layer 6036 by the dielectric material of another prism material 3. The thickness of the dielectric material of the prism 2 at the point between each discrete elongate electrode 6012 and the conducting layer 6038 determines an effective capacitance that contributes to a capacitance divider, which affects the potential at the discrete elongate electrode 6012. Each discrete elongate electrode 6012 is also separated from a conducting layer 6036 that is connected to a grounded alternating current supply 6024 by the dielectric material of a different prism material 3. The thickness of the dielectric material at the point between each discrete elongate electrode 6012 and the conducting layer 6036 determines an effective capacitance that contributes to a capacitance divider, which affects the potential at the discrete elongate electrode 6012.

FIG. 6E shows the effective circuit diagram 6050 created by the arrangement of conducting layers 6036, 6038, prism dielectric materials 2, 3 and discrete elongate electrodes 6012. The effective capacitance between each discrete elongate electrode 6012 and conducting layer 6036 are denoted as $C_{1n}$, the effective capacitance between each discrete elongate electrode 6012 and conducting layer 6038 is denoted as $C_{2n}$, where for i=1, 2, 3 . . . n, The value of each capacitance increases linearly with its number i: $C_{1i}=\varphi_0 i/n$, $$C_{2i} = \varphi_0\left(1 - \frac{i}{n}\right)$$

and decreases linearly on the other side, the voltage at the divider can be defined as:

$$\varphi_i = \varphi\frac{C_{2i}}{C_{1i} + C_{2i}}.$$

The prism materials 2, 3 are arranged such that the thickness d between the front side 6032 and the conducting layers 6036, 6038 varies linearly from the uppermost discrete elongate electrode 6012 to the lowermost discrete elongate electrode 6012. The thickness of the prism 2 varies according to the relationship $d_{1i}=d_0\cdot i$ and the thickness of the prism 3 varies according to the relationship $d_{2i}=d_0\cdot(n-i)$. Therefore the potential at each discrete elongate electrode is calculated as:

$$\varphi_i = \varphi\frac{\dfrac{C_0}{d_0\cdot(n-i)}}{\dfrac{C_0}{d_{0i}} + \dfrac{C_0}{d_0\cdot(n-i)}} = \varphi\frac{i}{n}.$$

The amplitude of radiofrequency potential of the discrete elongate electrodes 6012 of a system of plane electrodes 6000 is plotted as a function of the length perpendicular to the long axes of the discrete elongate electrodes 6012 at FIG. 7.

FIG. 8A shows an alternative arrangement of a system of plane electrodes 8000, which comprises a second prism 8004 of dielectric material 2 that links the discrete elongate electrodes 6012 (similar to the electrodes 6012 of FIG. 6, but not shown in relation to FIG. 8) of the front side 8002 of the system of plane electrodes 8000 to the rear conducting layer 8008, which is itself connected to ground 8012. The second prism of dielectric material 2 is placed the other side of the prism 8006 of dielectric material 3 that connects the discrete elongate electrodes 6012 of the front side 8002 of the system of plane electrodes 8000 to the conducting layer 8014 that is connected to a grounded alternating current source 8016, such that the discrete elongate electrodes 6012 span a first and second prism of dielectric material 2 as well as a prism of dielectric material 3. The thickness of the prisms 2 is the same between each discrete elongate electrode 6012 of the front side 8002 of the system of plane electrodes 8000 and the rear side conducting layers 8008, 8020 respectively. The middle prism 3 is therefore surrounded by two grounded outer conductive layers which serve as an electrostatic shield.

The systems of plane electrodes 6000, 8000 are positioned facing similar systems of plane electrodes 6000, 8000, thereby to form an ion mirror that operates in the way described above. A grounded plate forms the base of a parallel arrangement of two systems of plane electrodes 6000, 8000, arranged to extend from a first system of plane electrodes 6000, 8000 to a second system of plane electrodes 6000, 8000. In use, an alternating current is applied to each of the parallel systems of plane electrodes 6000, such that each of the systems of parallel electrodes in the ion mirror are concurrently oppositely biased, one positively, one negatively. The alternating current supplied to the systems of plane electrodes causes them to alternately temporally bias out of phase with one another. A charged ion that is accelerated towards the ion mirror is affected by the oscillating electric field generated by the alternating current between the electrodes. Accordingly, ions enter the ion mirrors through an aperture in a grounded plate and are reflected by the ion mirror, exiting through an aperture.

FIG. 8B shows the system of plane electrodes 8000 described with reference to FIG. 8A, wherein the system is arranged to form an ion mirror comprising substantially parallel side walls and a substantially parallel end cap and ground plate. The arrangement is made by amending the structure of FIG. 8A in an analogous manner to that described with references to FIGS. 4A to 4C and 5A to 5H. FIG. 8B shows the system of plane electrodes 8000 of FIG. 8A, opposite a mirror image complementary, but otherwise similar, electrode, and an end cap formed from a similar electrode arrangement to that shown at FIG. 8A The ion trap 8000' of FIG. 8B has discrete elongate electrodes 8002' that are positioned to bridge the prisms 2, 3 of dielectric material to provide an effective capacitor divider that is used to generate an electric field that is biased oppositely and out of phase with the system of plane electrodes that it faces. The end cap is effectively divided into two halves, each half is electrically connected to its respective system of plane electrodes, to provide an ion mirror 8000' that operates in the way described in relation to FIGS. 3A to 3D to reflect ions that enter at an aperture in a ground plate (not shown) that is substantially parallel and perpendicular to the end cap of the ion mirror, and to exit in the same plane, centrally between the system of plane electrodes 8000 arranged in the manner shown at FIG. 8B.

FIG. 9 is a perspective view 8000" of the arrangement described with reference to FIGS. 8A and 8B.

FIG. 10 shows the trajectory 1006 of ions trapped in an ion mirror apparatus, such as that described with reference to FIG. 9. FIG. 11A is a schematic diagram of a quadrupole arrangement 300 of electrodes forming an ion trap. There are shown four electrodes 306, 308, 310, 312. The electrodes 306, 308, 310, 312 are elongate electrodes whose axes are substantially parallel to one another (substantially parallel to the z-axis 103). The electrodes 306, 308 in the upper half of FIG. 11A are equivalent to the electrodes 20, 30 of FIG. 1. However, there is no grounded plate 50, rather there are similar electrodes 310, 312, shown in the lower half of FIG. 11A, which are arranged to reflect the arrangement of the electrodes 306, 308 in the upper half of FIG. 11A.

In use, electrodes 306, 312 are initially similarly biased positively and electrodes 308, 310 are similarly biased negatively. The voltage applied to the electrodes 306, 308, 310, 312 is then oscillated such that electrodes 306, 312 and electrodes 308, 310 are oppositely charged out of phase with one another, such that electrodes 306, 312 have opposite polarities compared with electrodes 308, 310 at all times. By altering the charge of the electrodes 306, 308, 310, 312 in this manner, an ion situated between the electrodes is subjected to oscillating electric fields, which can be tuned to trap the ion between the electrodes 306, 308, 310, 312. An ion trapped between the electrodes 306, 308, 310, 312, may move along a trajectory similar to the trajectory 414 depicted in FIG. 11B, such that ions have characteristic and secular frequencies which can be determined with high accuracy by measuring the induced current on the electrodes.

FIG. 11B is a schematic diagram illustrating ion movement 414 in the ion trap 400. The arrangement is the same as described with reference to FIG. 11A. There are shown four electrodes 406, 408, 410, 412. The electrodes 406, 408, 410, 412 are elongate electrodes that are substantially parallel to one another (substantially parallel to the z-axis 103). The electrodes 406, 408 in the upper half of FIG. 11B are equivalent to the electrodes 20, 30 of FIG. 1. However, there is no grounded plate 50, rather there similar electrodes 410, 412, shown in the lower half of FIG. 11B, which are arranged to reflect the electrodes 406, 408 in the upper half of FIG. 11B.

In use, electrodes 406, 412 are initially similarly biased positively and electrodes 408, 410 are similarly biased negatively. The voltage applied to the electrodes 406, 408, 410, 412 is then oscillated such that electrodes 406, 412 and electrodes 408, 410 are oppositely charged out of phase with one another. By altering the polarity of the electrodes 406, 408, 410, 412 in this manner, an ion situated between the electrodes is subjected to oscillating electric fields, which can be tuned to trap the ion between the electrodes 406, 408, 410, 412.

Ions are introduced into the ion trap 400 between electrodes 406, 408, 410, 412. Once introduced into the ion trap 400, the voltages applied to the electrodes 406, 408, 410, 412 are increased in order to hold the ions within the ion trap 400 and to cause the ions to move along detectable trajectories.

Advantageously, as opposed to known ion traps, such as Orbitraps, the ions follow a circular trajectory whilst also oscillating along the circular trajectory, thereby providing a much greater path length and detectable oscillations which provide additional information in respect of the ions trapped in the ion trap. The greater path length allows the sensitivity of the ion trap to be improved with respect to the mass of ions trapped within it.

Ions trapped in the structures described with reference to FIG. 11A and FIG. 11B are detected using image current detection and Fourier transform ion cyclotron resonance mass spectrometry. The much increased path and many circulations within the ion trap results in fluctuating image currents in the electrodes with increased sensitivity. These image currents may be monitored for the purpose of mass spectrometry.

FIG. 11C shows a further embodiment of the invention that is described above in relation to FIGS. 11A and 11B. FIG. 11C shows a schematic of systems of plane electrodes that are arranged to create an ion trap 500. The systems of plane electrodes are constructed from discrete elongate electrodes, which are described above. Each of the discrete elongate electrodes form a sandwich of at least two separated dielectric materials with at least two separate conducting layers, one conducting layer grounded, the other conducting layer connected to an alternating current source, thereby to form a capacitive divider, such that the potential of the discrete elongate electrodes varies from one discrete elongate electrode to the next. A first pair of systems of plane electrodes 502, 504 are situated parallel to one another, such that their discrete elongate electrodes face one another. A second pair of parallel systems of plane electrodes 506, 508 is situated adjacent and parallel to the first pair 502, 504, thereby to create the ion trap 500. The first pair of systems of plane electrodes 502, 504 are effectively bent at an angle of substantially ninety degrees to form a third side 503 of the ion trap 500. The second pair of system of plane electrodes 506, 508, are effectively bent at an angle of substantially ninety degrees to form a fourth side 507 of the ion trap 500. The third and fourth sides 503, 507 of the ion trap 500 are substantially parallel and form a four sided box like ion trap.

In use, the first pair of systems of plane electrodes 502, 504 are subject to opposed polarities of alternating RF current, such that the equivalent discrete elongate electrodes of one of the first pair of systems of plane electrodes 502 is always oppositely charged to the equivalent discrete elongate electrode of the other of the first pair of systems of plane electrodes 504. Similarly, the second pair of systems of plane electrodes 506, 508 are subject to opposed polarities of alternating RF current, such that the equivalent discrete elongate electrodes of one of the first pair of systems of plane electrodes 506 is always oppositely charged to the equivalent discrete elongate electrode of the other of the first pair of systems of plane electrodes 508 and so that the adjacent systems of plane electrodes 502, 506 are always oppositely charged and the adjacent systems of plane electrodes 504, 508 are always oppositely charged.

FIG. 12A is a perspective view of an ion trap 12000 that is constructed from systems of plane electrodes 12000, which are effectively four systems of plane electrodes 8000 described in reference to FIG. 8. The ion trap 12000 comprises four systems of plane electrodes that replicate the ion mirror arrangement described in relation to FIG. 11. Accordingly, there is shown a second prism of dielectric material 2 that links the discrete elongate electrodes 12002 (similar to the electrodes 6012 of FIG. 6, but not shown in relation to FIG. 8) of the front side 12003 of the system of plane electrodes 12000 to the rear conducting layer 12008, which is itself connected to ground 12012. The second prism of dielectric material 2 is placed the other side of the prism of dielectric material 3 that connects the discrete elongate electrodes 12002 of the front side 12002 of the system of plane electrodes 12000 to the conducting layer 12014 that is connected to a grounded alternating current source 12016, such that the discrete elongate electrodes 12002 span a first and second prism of dielectric material 2 as well as a prism of dielectric material 3. The thickness of the prisms 2 is the same between each discrete elongate electrode 12002 of the front side 12002 of the system of plane electrodes 12000 and the rear side conducting layers 12008, 12020 respectively. The middle prism 3 is therefore surrounded by two grounded outer conductive layers which serve as an electrostatic shield. Further, there is shown a symmetric structure that mirrors the above described structure, with connection to a second grounded alternating current source 12017. The mirrored structures are not electrically connected such that current can flow between the effectively separate electrodes. However, this construction provides a simple and effective means for constructing an ion trap 12000, by providing opposing and mirrored features, thereby to create a quadrupole that can be operated in the manner described in relation to FIG. 11.

FIG. 12B shows an alternative perspective arrangement of the electrodes shown at FIGS. 5G and 5H to provide an ion trap 12100. The ion trap 12100 is formed from planar dielectric material that is partitioned to form an ion trap as shown in FIGS. 5G and 5H, and includes a mirror image arrangement of the electrodes to form a box like structure. The ground plate that is used in the ion mirror of FIG. 5H is not seen in FIG. 12B, rather the structure is complemented with a mirror image structure that effectively reflects the ions introduced in the ion trap 12100 continuously upon the application of electric fields as applied in the manner described in relation to FIG. 11C.

Figure 12C:
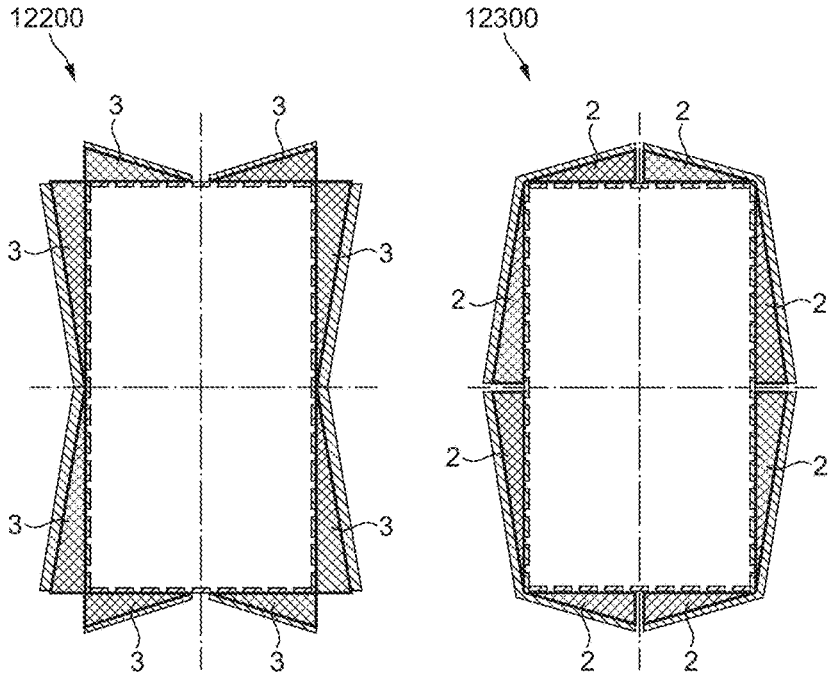

FIG. 12C shows two mirror image cross sections of formation of systems of plane electrodes, as described with reference to FIG. 9B to provide an ion trap. In a manner analogous to an ion trap described with reference to FIG. 12B, Cross section 12200 is the cross section through the dielectric prism material 3 that is used to provide the effective capacitors of a capacitive divider that is described in relation to FIG. 6E. Cross section 12300 is a cross section through the dielectric prism material 2 that is used to provide the effective capacitors of a capacitive divider that is described in relation to FIG. 6 A to E and FIGS. 8A and 8B.

FIG. 13 is a perspective view of an ion trap 13000 according to an embodiment of the invention. There is shown a system of plane electrodes 13002 having a front side and a back side 13004 formed from prismatic dielectric materials, as described in relation to FIG. 12 above. The system of plane electrodes 13002 is positioned to face opposing ground plate 13006, which comprises an aperture 13008. Ions are receivable in the trap through the aperture 13008. In use, the application of oscillating electric fields, as described in relation to the ion trap 12000 are applied to what is effectively half of the structure of 12000 with an opposite facing ground plate.

FIG. 14 is a perspective view of a time of flight mass spectrometer 700. There are shown multiple components assembled together to provide an apparatus for detecting the ions using an ion mirror, such as an ion mirror described above. The apparatus is connected to a vacuum pump (not shown) to produce a series of high vacuum chambers, in which ions are produced, directed and measured. The ions are produced by an ion conveyor 702. The ions are accelerated through chambers 704 using accelerator plates and are deflected by a repeller plate 704. The deflected ions pass into an ion mirror 708 through an aperture (not shown), in the manner described above in reference to FIGS. 1 to 2. The ions are reflected by the ion mirror 708 and exit the mirror through an exit aperture (not shown). The ions are then detected at a detector (not shown).

FIG. 15 shows a three-dimensional view of one embodiment of an ion trap 15000 with hyperbolic-field end-mirrors and a series of computer generated images from simulations, which depict ion traps 15000, each shown in cross section 15001, 15004, 15007 and plan view 15002, 15005, 15008. Corresponding axes of direction are shown at the bottom left hand side of FIG. 15 in respect of cross sections 15001, 15004, 15007 and at the bottom right hand side of FIG. 15 in respect of the plan views 15002, 15005, 15008. For each ion trap, there is shown an image current 15003, 15006, 15009 depicting the path of ions within the ion traps 15000. FIG. 15 (*b*) shows the path of ions 15003 in an ion trap, such as an ion trap described in relation to FIGS. 11 and 12. The path of ions 15003 is influenced by the application of an oscillating electric field.

FIG. 15(*c*) shows the path of ions 15006 in an ion trap, such as an ion trap described in relation to FIGS. 11 and 12. FIG. 15(*c*) differs from FIG. 15(*b*) in that in FIG. 15(*c*) a magnetic field is applied along the z axis 103. The application of magnetic field provides better focussing of the ions and therefore allows for easier detection of the ions.

FIG. 15(*d*) shows the path of ions 15007 in an ion trap that is subject to static electric fields and a static magnetic field along the z-axis 103.

The invention claimed is:

1. An ion mirror comprising:

a first means for producing a quadratic field along a first axis;

a second means for producing a quadratic field along a second axis, the axes being orthogonal; and a front plate defining an entry aperture for admission of ions, wherein the first means and the second means are arranged to generate a quadratic field along a first axis and a quadratic field along a second axis by application of a first potential at the first means and a second potential at the second means, wherein the first potential and the second potential are concurrently alternately and oppositely biased, thereby to define a plane of zero field in between the first means and the second means, the entry aperture lying in the plane of zero field.

2. The ion mirror as claimed in claim 1, wherein at least one of the first and second means is arranged to produce a hyberbolic electric field.

3. The ion mirror as claimed in claim 1, wherein the front plate includes an exit aperture in the plane of zero field between the first and second means and displaced from the entry aperture.

4. The ion mirror as claimed in claim 1, wherein the first means comprises a series of discrete electrodes.

5. The ion mirror as claimed in claim 4, wherein the series of discrete electrodes comprises a capacitive divider that is configurable to apportion different potentials to different ones of the discrete electrodes in the series of discrete electrodes.

6. The ion mirror as claimed in claim 5, wherein the capacitive divider is arranged such that the capacitance of each of the discrete electrodes increases linearly across the series of discrete electrodes from one discrete electrode to the next.

7. The ion mirror as claimed in claim 4, wherein the series of discrete electrodes is a system of substantially parallel plane electrodes.

8. The ion mirror as claimed in claim 4, wherein the series of discrete electrodes is formed on a first dielectric material.

9. The ion mirror as claimed in claim 8, wherein the first dielectric material comprises a further electrode on an opposite side of the first dielectric material from the series of discrete electrodes, thereby to form a series of capacitors.

10. The ion mirror as claimed in claim 9, wherein the first dielectric material is a different thickness at a point between a first discrete electrode of the series of discrete electrodes and the further electrode and at a point between a second discrete electrode of the series of discrete electrodes and the further electrode, thereby to create at least two capacitors of different capacitances.

11. The ion mirror as claimed in claim 8, wherein the series of discrete electrodes is also formed on a second dielectric material which comprises a further electrode on an opposite side of the second dielectric material from the series of discrete electrodes, thereby to form a series of capacitors.

12. The ion mirror as claimed in claim 11, wherein the second dielectric material is a different thickness at a point between a first discrete electrode of the series of discrete electrodes and the further electrode and at a point between a second discrete electrode of the series of discrete electrodes and the further electrode of the second dielectric thereby to create at least two capacitors of different capacitances.

13. The ion mirror as claimed in claim 12, wherein the further electrode of the first dielectric and the further electrode of the second dielectric are configured to provide a capacitive divider.

14. The ion mirror as claimed in claim 1, wherein the first means comprises a first elongate conductor, and the second means comprises a second elongate conductor, the first elongate conductor being parallel to the second elongate conductor and spaced therefrom.

15. A mass spectrometer including an ion mirror according to claim 1.

16. An ion mirror assembly comprising:

an ion mirror comprising:

a first means for producing a quadratic field along a first axis;

a second means for producing a quadratic field along a second axis, the axes being orthogonal;

wherein the first means and the second means are arranged to generate a quadratic field along a first axis and a quadratic field along a second axis by application of a first potential at the first means and a second potential at the second means, wherein the first potential and the second potential are concurrently alternately and oppositely biased, thereby to define a plane of zero field in between the first means and the second means;

and the assembly further comprising:

means defining a direction of entry of ions into the ion mirror, the defined direction of entry lying substantially in the plane of zero field.

17. The ion mirror assembly as claimed in claim 16, wherein the ion mirror further comprises a front plate defining an entry aperture for admission of ions, the entry aperture lying in the plane of zero field.

18. A mass spectrometer including an ion mirror assembly according to claim 16.

19. An ion trap comprising:

a first means for producing a quadratic field along a first axis, a second means for producing a quadratic field along a second axis, a third means for producing a quadratic field along a third axis, a fourth means for producing a quadratic field along a fourth axis, the first axis, second axis, third axis and fourth axis being mutually orthogonal about a notional central axis;

means to produce a magnetic field substantially perpendicular to each of the first axis, second axis, third axis and fourth axis at each end of the ion trap;

wherein the first means, the second means, the third means and the fourth means are arranged such that an ion introduced between the first means, second means, third means and fourth means and the magnetic means is trappable upon application of the quadratic fields along the first, second, third and fourth axes.

20. The ion trap as claimed in claim 19, wherein the ion trap includes means to image ions trapped in the trap by monitoring image currents.

21. The ion trap as claimed in claim 20, wherein each magnetic means includes an end plate and the imaging means is arranged to monitor the image currents in the end plates.

22. The ion trap as claimed in claim 19, wherein the first and third means are arranged to produce quadratic fields along the first and third axes in phase with one another and out of phase with the quadratic fields along the second and fourth axes, arranged to be produced by the second and fourth means, wherein the quadratic fields produced by the first and third axes are provided by application of a first potential at the first and third means and the quadratic fields produced by the second and fourth axis are provided by application of a second potential at the second and fourth means, wherein the first potential and the second potential are concurrently alternately and oppositely biased.

23. The ion trap as claimed in claim 19, wherein each of the first, second, third and fourth means is arranged to produce a hyberbolic electric field.

24. The ion trap as claimed in claim 19, wherein each of the first, second, third and fourth means comprises a series of discrete electrodes.

25. The ion trap as claimed in claim 24, wherein the series of discrete electrodes comprises a capacitive divider that is configurable to apportion different potentials to different ones of the discrete electrodes in the series of discrete electrodes.

26. The ion trap as claimed in claim 25, wherein the capacitive divider is arranged such that the capacitance of each of the discrete electrodes increases linearly across the series of discrete electrodes from one discrete electrode to the next.

27. The ion trap as claimed in claim 24, wherein the series of discrete electrodes is a system of substantially parallel plane electrodes.

28. The ion trap as claimed in claim 24, wherein the series of discrete electrodes are formed on a dielectric material.

29. The ion trap as claimed in claim 28, wherein a further electrode is provided on the opposite side of the first dielectric material from the series of discrete electrodes, thereby to form a capacitor.

30. The ion trap as claimed in claim 29, wherein the dielectric material is a different thickness at a point between a first discrete electrode of the series of discrete electrodes and the further electrode and at a point between a second discrete electrode of the series of discrete electrodes and the further electrode, thereby to create two capacitors of different capacitances.

31. The ion trap as claimed in claim 28, wherein the series of discrete electrodes is also formed on a second dielectric material and a further electrode is provided on an opposite side of the second dielectric material from the series of discrete electrodes, thereby to form a capacitor.

32. The ion trap as claimed in claim 31, wherein the second dielectric material is a different thickness at a point between a first discrete electrode of the series of discrete electrodes thereon and the further electrode and at a point between a second discrete electrode of the series of discrete electrodes thereon and the further electrode of the second dielectric thereby to create two capacitors of different capacitances.

33. The ion trap as claimed in claim 32, wherein the further electrode of the first dielectric and the further electrode of the second dielectric are configured to provide a capacitive divider.

34. A mass spectrometer including an ion trap according to claim 19.

* * * * *